US011295677B2

(12) United States Patent
An et al.

(10) Patent No.: US 11,295,677 B2
(45) Date of Patent: Apr. 5, 2022

(54) DISPLAY DRIVER INTEGRATED CIRCUIT AND DRIVING METHOD

(71) Applicant: SAMSUNG ELECTRONICS CO., LTD., Suwon-si (KR)

(72) Inventors: Jooyoung An, Seoul (KR); Jiheon Ok, Hwaseong-si (KR); Hyunwook Lim, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/208,206

(22) Filed: Mar. 22, 2021

(65) Prior Publication Data

US 2022/0013069 A1 Jan. 13, 2022

(30) Foreign Application Priority Data

Jul. 7, 2020 (KR) ..... 10-2020-0083188

(51) Int. Cl.
*G09G 3/3266* (2016.01)

(52) U.S. Cl.
CPC ... *G09G 3/3266* (2013.01); *G09G 2320/0285* (2013.01); *G09G 2320/045* (2013.01)

(58) Field of Classification Search
CPC ..... G09G 3/3266–3291; G09G 3/3685–3696; G09G 2310/0243; G09G 2310/0264–0275; G09G 2310/0289; G09G 2320/0242; G09G 2320/0285–0295; G09G 2320/043–048
See application file for complete search history.

(56) References Cited

U.S. PATENT DOCUMENTS 8,922,595 B2 12/2014 Ahn et al.
9,767,734 B2 9/2017 Jun et al.
(Continued)

FOREIGN PATENT DOCUMENTS

KR 20170088452 A * 8/2017 ..... G09G 3/3208

OTHER PUBLICATIONS

English translation of KR-20170088452-A (Year: 2017).*

*Primary Examiner* — Nathan Danielsen
(74) *Attorney, Agent, or Firm* — F. Chau & Associates, LLC

(57) ABSTRACT

A display driver integrated circuit includes a first memory, a compensator, an accumulator and a second memory. The first memory stores a plurality of compensation data that are used to compensate for deterioration of a plurality of pixels. The compensator generates a plurality of output image data for image display by compensating a plurality of input image data based on the plurality of compensation data. The accumulator groups the plurality of pixels into a plurality of blocks, generates a plurality of block image data by sampling the plurality of output image data in block units, generates a plurality of block accumulation data in block units based on the plurality of block image data, and generates a plurality of pixel accumulation data in pixel units by synthesizing portions of the plurality of output image data and portions of the plurality of block accumulation data. The second memory stores the plurality of block accumulation data in a first period. The plurality of pixel accumulation data may be stored in a third memory in a second period longer than the first period.

20 Claims, 20 Drawing Sheets

(56) References Cited

U.S. PATENT DOCUMENTS

| | | | | |
|---|---|---|---|---|
| 9,773,455 | B2 | 9/2017 | Chung et al. | |
| 9,940,872 | B2 | 4/2018 | An et al. | |
| 10,163,389 | B2 | 12/2018 | An et al. | |
| 10,170,039 | B2 | 1/2019 | Ishida | |
| 10,453,375 | B2 | 10/2019 | Drzaic et al. | |
| 2016/0140895 | A1* | 5/2016 | Park | G09G 3/3208 345/690 |
| 2017/0162109 | A1* | 6/2017 | An | G09G 3/2003 |
| 2019/0156746 | A1 | 5/2019 | Kim et al. | |
| 2020/0111455 | A1* | 4/2020 | Lee | G09G 3/3208 |
| 2020/0211454 | A1* | 7/2020 | Ohnishi | G09G 3/30 |

* cited by examiner

FIG. 10D

M(6) IN MEMORY2

| | |
|---|---|
| $M_{1,1}(6)$ | $M_{1,2}(6)$ |
| $M_{2,1}(6)$ | $M_{2,2}(6)$ |
| $M_{3,1}(6)$ | 0 |

DISPLAY DRIVER INTEGRATED CIRCUIT AND DRIVING METHOD

CROSS-REFERENCE TO RELATED APPLICATION

This application claims priority under 35 USC § 119 to Korean Patent Application No. 10-2020-0083188, filed on Jul. 7, 2020 in the Korean Intellectual Property Office (KIPO), the content of which is herein incorporated by reference in its entirety.

FIELD

The present disclosure generally relates to semiconductor integrated circuits, and more particularly relates to a display driver integrated circuit for driving display panels, display devices including the display driver integrated circuits, and methods of driving display panels using the display driver integrated circuits.

DISCUSSION OF RELATED ART

As information technology develops, display devices are becoming increasingly important to provide information to users. Various display devices such as liquid crystal displays (LCDs), plasma displays, and electroluminescent displays have gained popularity. Among these, electroluminescent displays have quick response speeds and low power consumption, using light-emitting diodes (LEDs) or organic light-emitting diodes (OLEDs) that emit light through recombination of electrons and holes.

An electroluminescent display may have rapid response and low power consumption. An OLED display device may supply a current corresponding to a data signal using driving transistors of respective pixels to generate lights through the OLEDs of the respective pixels. As such, the electroluminescent display device displays an image using a current. The driving transistors and the OLEDs may deteriorate with elapsed time of usage, heat cycles, mechanical stress, and/or age, and various technologies have been researched to compensate for this phenomenon.

SUMMARY

At least one embodiment of the present disclosure provides a display driver integrated circuit capable of efficiently compensating for deterioration of pixels included in a display panel.

At least one embodiment of the present disclosure provides a display device including the display driver integrated circuit.

At least one embodiment of the present disclosure provides a method of driving a display panel using the display driver integrated circuit.

According to an embodiment, a display driver integrated circuit for driving a display panel including a plurality of pixels includes: a memory configured to store a plurality of compensation data; a compensator configured to generate a plurality of output image data based on the plurality of compensation data; and an accumulator configured to group the plurality of pixels into a plurality of blocks, to generate a plurality of block image data by sampling the plurality of output image data in block units, to generate a plurality of block accumulation data in block units based on the plurality of block image data and to store the plurality of block accumulation data into the memory in a first period, and to generate a plurality of pixel accumulation data in pixel units by synthesizing portions of the plurality of output image data and portions of the plurality of block accumulation data.

According to an embodiment, a display driver integrated circuit for driving a display panel including a plurality of pixels includes a first memory, a compensator, an accumulator and a second memory. The first memory stores a plurality of compensation data that are used to compensate for deterioration of the plurality of pixels. The compensator generates a plurality of output image data for image display by compensating a plurality of input image data based on the plurality of compensation data. The accumulator groups the plurality of pixels into a plurality of blocks, generates a plurality of block image data by sampling the plurality of output image data in block units, generates a plurality of block accumulation data in block units based on the plurality of block image data, and generates a plurality of pixel accumulation data in pixel units by synthesizing portions of the plurality of output image data and portions of the plurality of block accumulation data. The second memory stores the plurality of block accumulation data every first period. The plurality of pixel accumulation data may be stored in a third memory every second period longer than the first period, and the third memory is located outside the display driver integrated circuit.

According to an embodiment, a display device includes a display panel and a display driver integrated circuit. The display panel includes a plurality of pixels. The display driver integrated circuit drives the display panel, and includes a first memory, a compensator, an accumulator and a second memory. The first memory stores a plurality of compensation data that are used to compensate for deterioration of the plurality of pixels. The compensator generates a plurality of output image data for image display by compensating a plurality of input image data based on the plurality of compensation data. The accumulator groups the plurality of pixels into a plurality of blocks, generates a plurality of block image data by sampling the plurality of output image data in block units, generates a plurality of block accumulation data in block units based on the plurality of block image data, and generates a plurality of pixel accumulation data in pixel units by synthesizing portions of the plurality of output image data and portions of the plurality of block accumulation data. The second memory stores the plurality of block accumulation data every first period. The plurality of pixel accumulation data may be stored in a third memory every second period longer than the first period, and the third memory is located outside the display driver integrated circuit.

According to an embodiment, in a method of driving a display panel including a plurality of pixels, a plurality of compensation data that are used to compensate for deterioration of the plurality of pixels are stored in a first memory. A plurality of output image data for image display are generated by compensating a plurality of input image data based on the plurality of compensation data. A plurality of block image data may be generated by grouping the plurality of pixels into a plurality of blocks and by sampling the plurality of output image data in block units. A plurality of block accumulation data may be generated in block units based on the plurality of block image data. The plurality of block accumulation data may be stored in a second memory every first period. A plurality of pixel accumulation data may be generated in pixel units by synthesizing portions of the plurality of output image data and portions of the plurality of block accumulation data. The plurality of pixel accumulation data may be stored in a third memory every second period longer than the first period. The third memory is an external memory.

In the display driver integrated circuit, the display device and the method of driving the display panel according to embodiments, the deterioration of the plurality of pixels may be compensated based on the cumulative compensating scheme. The plurality of pixel accumulation data corresponding to the amount of usage or deterioration of the plurality of pixels may be stored in an external nonvolatile memory. Accordingly, an internal volatile memory having relatively large capacity may be omitted, and the power consumption and chip size may be minimized.

In addition, only the plurality of compensation data, which are portions of the plurality of pixel accumulation data stored in the external nonvolatile memory, may be loaded and stored in an internal volatile memory. The compensating operation may be performed based on the plurality of compensation data. Accordingly, the internal volatile memory may be implemented with relatively small capacity, and a time required to load the plurality of compensation data may be minimized.

Further, to reflect frequent changes in images, the plurality of block accumulation data, which are accumulated image information of small size and low resolution, may be stored in another internal volatile memory in a relatively short period. Additionally, the plurality of pixel accumulation data, which are accumulated image information of large size and high resolution, may be stored in the external nonvolatile memory in a relatively long period. Accordingly, another internal volatile memory may be implemented with relatively small capacity, and the power consumption and chip size may be minimized without degrading the compensating performance.

BRIEF DESCRIPTION OF THE DRAWINGS

Illustrative, non-limiting embodiments will be more clearly understood from the following detailed description taken in conjunction with the accompanying drawings, in which:

FIGS. 10A, 10B, 10C and 10D are conceptual diagrams for describing operations of a display driver integrated circuit according to an embodiment;

DETAILED DESCRIPTION

Figure 1:
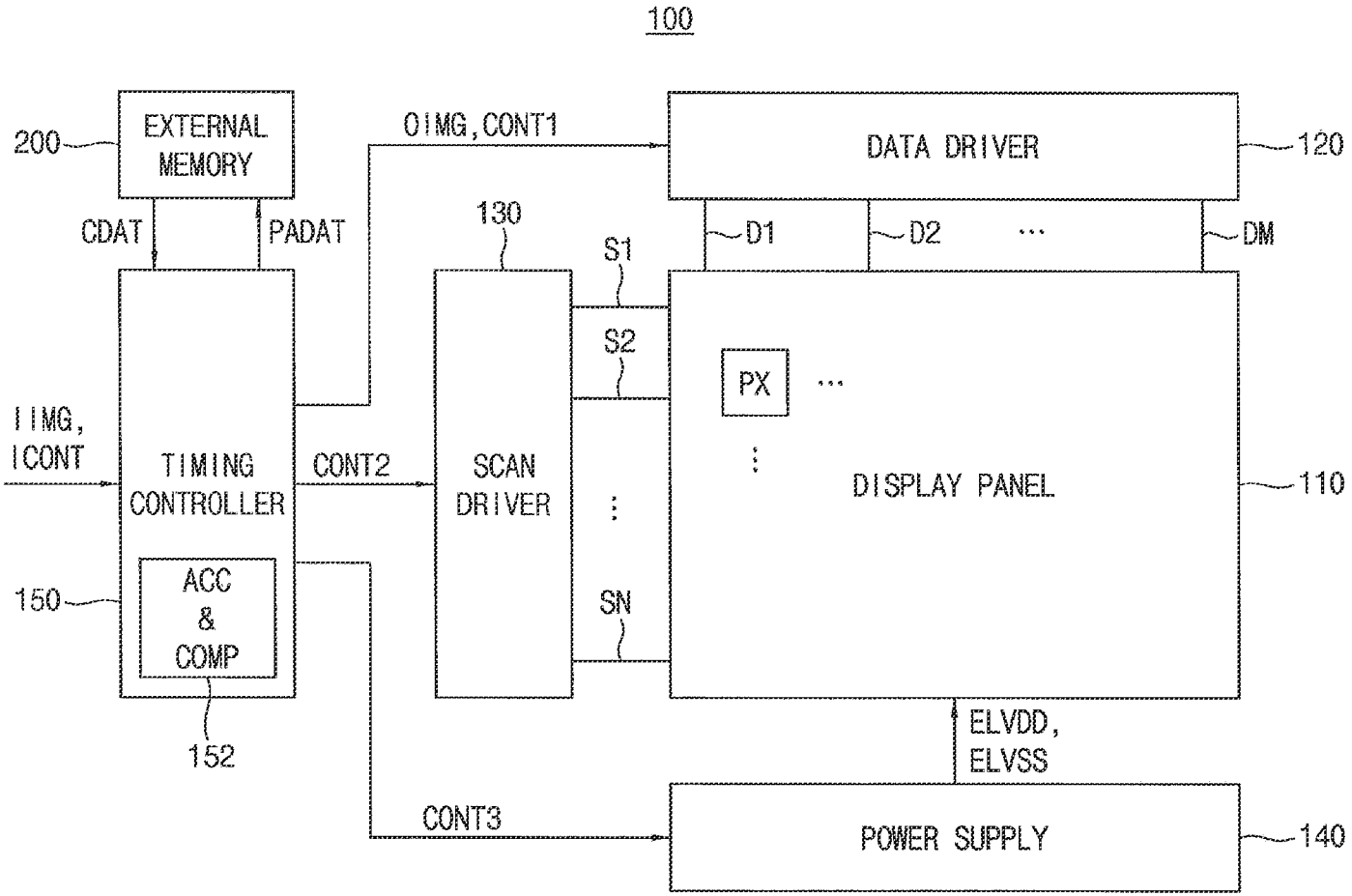
FIG. 1 is a block diagram illustrating a display driver integrated circuit and a display device including the display driver integrated circuit according to an embodiment.

The present disclosure will be described more fully with reference to the accompanying drawings, in which illustrative embodiments are shown. The present disclosure may, however, be embodied in many different forms, and should not be construed as limited to the embodiments set forth herein. Like reference numerals may refer to like elements throughout this application.

FIG. 1 is a block diagram illustrating a display driver integrated circuit and a display device including the display driver integrated circuit according to an embodiment.

Referring to FIG. 1, a display device 100 includes a display panel 110 and a display driver integrated circuit. The display driver integrated circuit may include a data driver 120, a scan driver 130, a power supply 140, and a timing controller 150. In other words, elements other than the display panel 110 and an external memory 200, among the elements illustrated in FIG. 1, may form the display driver integrated circuit.

The display panel 110 operates (e.g., displays an image) based on image data or a data signal. The display panel 110 may be connected to the data driver 120 through a plurality of data lines D1, D2, . . . , DM, and may be connected to the scan driver 130 through a plurality of scan lines S1, S2, . . . , SN. The plurality of data lines D1, D2, . . . , DM may extend in a first direction, and the plurality of scan lines S1, S2, . . . , SN may extend in a second direction crossing (e.g., substantially perpendicular to) the first direction.

The display panel 110 may include a plurality of pixels PX arranged in a matrix having a plurality of rows and a plurality of columns. As will be described in greater detail with reference to FIG. 2, each of the plurality of pixels PX may include a light emitting element and a driving transistor for driving the light emitting element. Each of the plurality of pixels PX may be electrically connected to a respective one of the plurality of data lines D1, D2, . . . , DM and a respective one of the plurality of scan lines S1, S2, . . . , SN.

In an embodiment, the display panel 110 may be a self-emitting display panel that emits light without the use of a backlight unit. For example, the display panel 110 may be an organic light-emitting diode (OLED) display panel including an OLED as the light emitting element.

In an embodiment, each of the plurality of pixels PX included in the display panel 110 may have various configurations according to a driving scheme of the display device 100. For example, the display device 100 may be driven with an analog or a digital driving scheme. While the analog driving scheme produces grayscale using variable voltage levels corresponding to input data, the digital driving scheme produces grayscale using variable time duration in which the LED (e.g., OLED, but not limited thereto) emits light. The analog driving scheme may be implemented using a driving integrated circuit (IC) that is complicated to manufacture if the display is large and has high resolution. The digital driving scheme, on the other hand, can readily accomplish high resolution through a simpler IC structure. An illustrative structure of each pixel PX will be described with reference to FIG. 2.

The timing controller 150 controls overall operations of the display device 100. For example, the timing controller 150 may receive an input control signal ICONT from an external host device, and may provide predetermined control signals to the data driver 120, the scan driver 130 and the power supply 140 based on the input control signal ICONT to control the operations of the display device 100. For example, the input control signal ICONT may include a master clock signal, a data enable signal, a horizontal synchronization signal, a vertical synchronization signal, or the like.

The timing controller 150 receives a plurality of input image data IIMG from the external host device, and generates a plurality of output image data OIMG for image display based on the plurality of input image data IIMG. For example, the input image data may include red image data, green image data and blue image data. In addition, the input image data may include white image data. Alternatively, the input image data may include magenta image data, yellow image data, cyan image data, and the like. Each of the plurality of input image data IIMG and each of the plurality of output image data OIMG may correspond to one frame image.

The timing controller 150 includes an accumulator and compensator (ACC & COMP) 152. The accumulator and compensator 152 may receive a plurality of compensation data CDAT from the external memory 200, and store the plurality of compensation data CDAT such as in the accumulator and compensator 152. The plurality of compensation data CDAT are used to compensate for deterioration (e.g., burn-in) of the plurality of pixels PX. The accumulator and compensator 152 may generate the plurality of output image data OIMG by compensating the plurality of input image data IIMG based on the plurality of compensation data CDAT. In addition, the accumulator and compensator 152 may internally store first image information or first accumulation values for a first period, and output second image information or second accumulation values for a second period longer than the first period such as to externally store the second image information or the second accumulation values. The first image information or the first accumulation values are information of low-resolution and associated with the amount of deterioration or usage of the plurality of pixels PX. The second image information or the second accumulation values are information of high-resolution and generated based on the first image information or the first accumulation values. A plurality of pixel accumulation data PADAT that are output to and stored in the external memory 200 disposed outside the display driver integrated circuit may correspond to the second image information or the second accumulation values. A more detailed structure and operation of the accumulator and compensator 152 will be described with reference to FIGS. 3 through 14.

Due to the deterioration of the plurality of pixels PX, an image sticking or ghosting phenomenon may occur in which an often-used image form permanently appears on a screen, potentially affecting image quality. Techniques of compensating for the deterioration of the plurality of pixels PX may be roughly divided into two schemes. One is a scheme of detecting and compensating for the amount of the deterioration by sensing electrical characteristics of the plurality of pixels PX using a separate circuit, and the other is a scheme of predicting and compensating for the total amount of the deterioration by predicting the amount of the deterioration (e.g., based on cumulative usage) using input images and by accumulating the amount of the deterioration. The first scheme (e.g., a sensing scheme) may use a separate circuit for sensing the electrical characteristics, and a separate sensing operation may be additionally performed. The second scheme (e.g., a cumulative compensating scheme) may be used in a mobile device because the separate sensing circuit and the separate sensing operation need not be used, and the compensation is performed in real time without an additional operation. The accumulator and compensator 152 that is included in the display driver integrated circuit and the display device 100 according to an embodiment may be implemented based on the above-described second scheme (e.g., the cumulative compensating scheme).

The data driver 120 may generate a plurality of data voltages based on a control signal CONT1 and the plurality of output image data OIMG, and may apply the plurality of data voltages to the display panel 110 through the plurality of data lines D1, D2, . . . , DM. For example, the data driver 120 may include a digital-to-analog converter (DAC) that converts the plurality of output image data OIMG in a digital form into the plurality of data voltages in an analog form.

The scan driver 130 may generate a plurality of scan signals based on a control signal CONT2, and may apply the plurality of scan signals to the display panel 110 through the plurality of scan lines S1, S2, . . . , SN. The plurality of scan lines S1, S2, . . . , SN may be sequentially activated based on the plurality of scan signals.

In an embodiment, the data driver 120, the scan driver 130 and the timing controller 150 may be implemented as one integrated circuit (IC). In another embodiment, the data driver 120, the scan driver 130 and the timing controller 150 may be implemented as two or more integrated circuits. A driving module including at least the timing controller 150 and the data driver 120 may be referred to as a timing controller embedded data driver (TED).

The power supply 140 may supply a first power supply voltage ELVDD and a second power supply voltage ELVSS to the display panel 110 based on a control signal CONT3. For example, the first power supply voltage ELVDD may be a high power supply voltage, and the second power supply voltage ELVSS may be a low power supply voltage.

In an embodiment, at least some of the elements included in the display driver integrated circuit may be disposed (e.g., directly mounted) on the display panel 110, or may be connected to the display panel 110 in a type of tape carrier package (TCP). Alternatively, at least some of the elements included in the display driver integrated circuit may be integrated on the display panel 110. In an embodiment, the elements included in the display driver integrated circuit may be respectively implemented with separate circuits/modules/chips. In other embodiments, on the basis of a layout optimization function, some of the elements included in the display driver integrated circuit may be combined into one circuit/module/chip, or may be further separated into a plurality of circuits/modules/chips.

Figure 2:
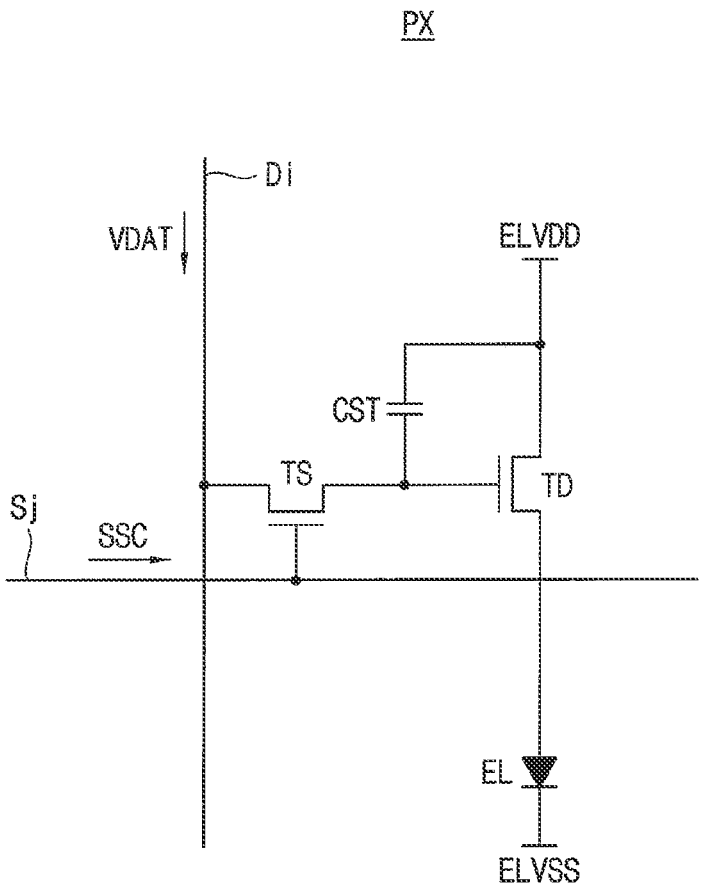
FIG. 2 is a circuit diagram illustrating an example of a pixel included in a display panel in the display device of FIG. 1.

FIG. 2 is a circuit diagram illustrating an example of a pixel included in a display panel in the display device of FIG. 1.

Referring to FIG. 2, each pixel PX may include a switching transistor TS, a storage capacitor CST, a driving transistor TD and an organic light-emitting diode EL.

The switching transistor TS may have a first electrode connected to a data line Di, a second electrode connected to the storage capacitor CST, and a gate electrode connected to a scan line Sj. The switching transistor TS may transfer a data voltage VDAT received from the data driver 120 to the storage capacitor CST in response to a scan signal SSC received from the scan driver 130.

The storage capacitor CST may have a first electrode connected to the first power supply voltage ELVDD and a second electrode connected to a gate electrode of the driving transistor TD. The storage capacitor CST may store the data voltage VDAT transferred through the switching transistor TS.

The driving transistor TD may have a first electrode connected to the first power supply voltage ELVDD, a second electrode connected to the organic light-emitting diode EL, and the gate electrode connected to the storage capacitor CST. The driving transistor TD may be turned on or off according to the data voltage VDAT stored in the storage capacitor CST.

The organic light-emitting diode EL may have an anode electrode connected to a second electrode of the driving transistor TD and a cathode electrode connected to the second power supply voltage ELVSS. In an alternate embodiment, the organic light-emitting diode EL may have an anode electrode connected to the first power supply voltage ELVDD and a cathode electrode connected to the first electrode of the driving transistor TD.

The organic light-emitting diode EL may emit light based on a current flowing from the first power supply voltage ELVDD to the second power supply voltage ELVSS while the driving transistor TD is turned on. The brightness of the pixel PX may increase as the current flowing through the organic light-emitting diode EL increases.

Although FIG. 2 illustrates an OLED pixel as an example of each pixel PX that may be included in the display panel 110, it would be understood that embodiments are not limited to OLED pixels and may be applied to pixels of various types and configurations.

Figure 3:
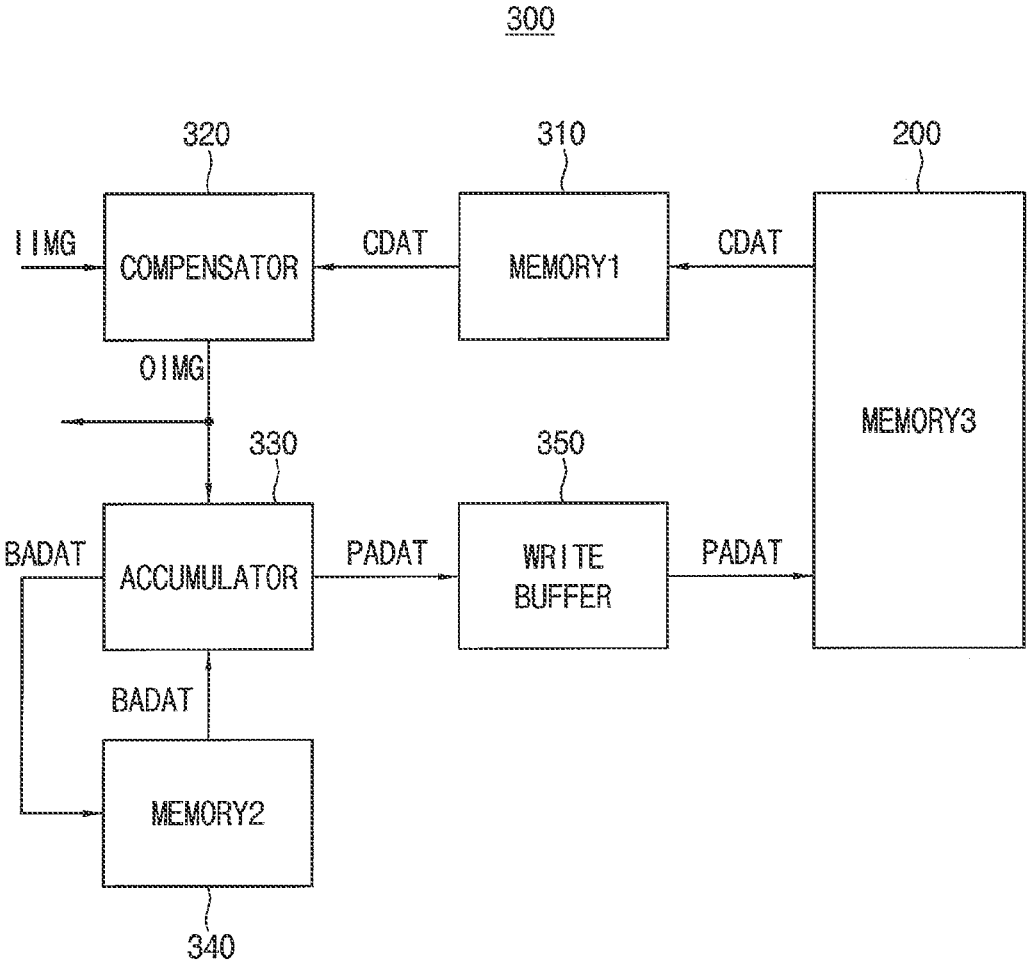
FIG. 3 is a block diagram illustrating an accumulator and compensator included in a display driver integrated circuit according to an embodiment.

FIG. 3 is a block diagram illustrating an accumulator and compensator included in a display driver integrated circuit according to an embodiment.

Referring to FIG. 3, an accumulator and compensator 300 includes a first memory 310, a compensator 320, an accumulator 330 and a second memory 340. The accumulator and compensator 300 may further include a write buffer 350.

The first memory 310 stores the plurality of compensation data CDAT that are used to compensate for the deterioration of the plurality of pixels PX. The plurality of compensation data CDAT may be loaded from a third memory 200 that is located outside the accumulator and compensator 300, and may be stored in the first memory 310. An operation of loading the plurality of compensation data CDAT will be described with reference to FIGS. 13A and 13B.

In an embodiment, the plurality of compensation data CDAT may be portions of the plurality of pixel accumulation data PADAT stored in the third memory 200. Configurations of the plurality of compensation data CDAT and the plurality of pixel accumulation data PADAT will be described with reference to FIG. 12.

The compensator 320 generates the plurality of output image data OIMG for image display by compensating the plurality of input image data IIMG based on the plurality of compensation data CDAT. A detailed structure and operation of the compensator 320 will be described with reference to FIGS. 4 and 5.

The accumulator 330 groups the plurality of pixels PX into a plurality of blocks each including two or more pixels, generates a plurality of block image data by sampling the plurality of output image data OIMG in units of blocks (or in block units), generates a plurality of block accumulation data BADAT in block units based on the plurality of block image data, and generates the plurality of pixel accumulation data PADAT in units of pixels (or in pixel units) by synthesizing (or combining) portions of the plurality of output image data OIMG and portions of the plurality of block accumulation data BADAT. A detailed structure and operation of the accumulator 330 will be described with reference to FIGS. 4 through 7.

In an embodiment, as will be described with reference to FIGS. 10A and 10B, each of the plurality of block accumulation data BADAT may correspond to the plurality of blocks and may include a plurality of block accumulation values for the plurality of blocks. The plurality of block accumulation data BADAT may be generated for the plurality of blocks in the first period (e.g., a period T1 in FIGS. 10A and 10B). The plurality of block accumulation data BADAT may correspond to the first image information or the first accumulation values of low-resolution described with reference to FIG. 1.

In an embodiment, as will be described with reference to FIGS. 100 and 11C, each of the plurality of pixel accumulation data PADAT may correspond to one of the plurality of blocks and may include a plurality of pixel accumulation values for one of the plurality of blocks. Pixel accumulation data corresponding to the same block among the plurality of pixel accumulation data PADAT may be generated for the same block in the second period (e.g., a period T2 in FIG. 11C) longer than the first period T1. The plurality of pixel accumulation data PADAT may correspond to the second image information or the second accumulation values of high-resolution described with reference to FIG. 1.

In an embodiment, at least a part of the compensator 320 and/or the accumulator 330 may be implemented as hardware. For example, at least a part of the compensator 320 and/or the accumulator 330 may be included in a computer-based electronic system. In another embodiment, at least a part of the compensator 320 and/or the accumulator 330 may be implemented as instruction codes or program routines (e.g., a software program). For example, the instruction codes or the program routines may be executed by a computer-based electronic system, and may be stored in any storage device located inside or outside of the computer-based electronic system.

The second memory 340 stores the plurality of block accumulation data BADAT in the first period T1. The second memory 340 may be implemented separately from the first memory 310 in the accumulator and compensator 300, without limitation.

The write buffer 350 may output the plurality of pixel accumulation data PADAT to the third memory 200 that is an external memory.

The third memory 200 stores the plurality of pixel accumulation data PADAT in the second period T2. For example, the pixel accumulation data corresponding to the same block among the plurality of pixel accumulation data PADAT may be stored in the third memory 200 in the second period T2.

In an embodiment, each of the first memory 310 and the second memory 340 may include a volatile memory, and the third memory 200 may include a nonvolatile memory. For example, the volatile memory may include any volatile memories, e.g., a dynamic random-access memory (DRAM), a static random-access memory (SRAM), or the like. For example, the nonvolatile memory may include any nonvolatile memories, such as a flash memory, a phase random access memory (PRAM), a resistive random-access memory (RRAM), a nano floating gate memory (NFGM), a polymer random access memory (PoRAM), a magnetic random-access memory (MRAM), a ferroelectric random-access memory (FRAM), a thyristor random access memory (TRAM), or the like.

Figure 4:
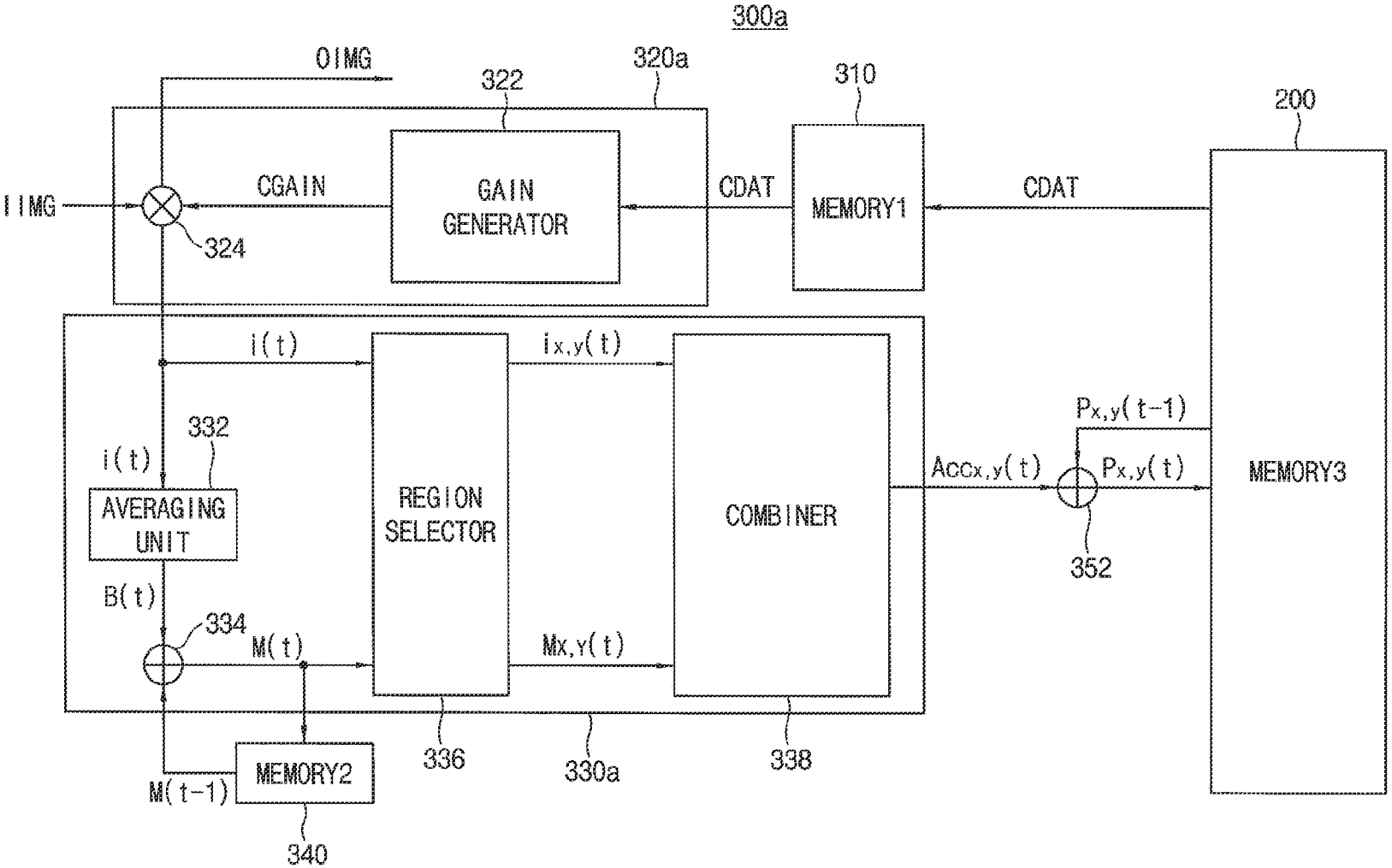
FIG. 4 is a block diagram illustrating an example of an accumulator and compensator according to an embodiment.
Figure 5:
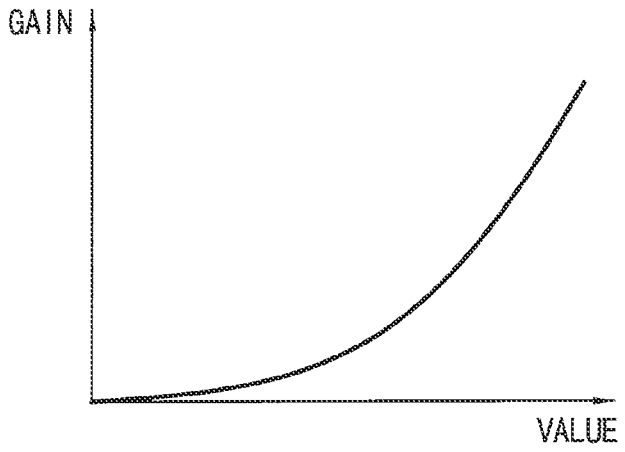
FIG. 5 is a graphical diagram for describing operation of a compensator included in the accumulator and compensator of FIG. 4.

FIG. 4 is a block diagram illustrating an example of an accumulator and compensator according to an embodiment. FIG. 5 is a diagram for describing an operation of a compensator included in the accumulator and compensator of FIG. 4.

Referring to FIGS. 4 and 5, an accumulator and compensator 300*a* includes the first memory 310, a compensator 320*a*, an accumulator 330*a* and the second memory 340, and may further include an adder 352. The first memory 310, the second memory 340 and the third memory 200 in FIG. 4 may be substantially the same as the first memory 310, the second memory 340 and the third memory 200 in FIG. 3, respectively. Duplicate description may be omitted.

The compensator 320*a* may include a gain generator 322 and a multiplier 324.

The gain generator 322 may generate a plurality of compensation gains CGAIN based on the plurality of compensation data CDAT. For example, the plurality of compensation data CDAT may include a plurality of compensation values for the plurality of pixels PX. The gain generator 322 may convert the plurality of compensation values into the plurality of compensation gains CGAIN.

For example, the gain generator 322 may convert the plurality of compensation values into the plurality of compensation gains CGAIN based on a graph of FIG. 5. In the graph of FIG. 5, a horizontal axis may represent the plurality of compensation values, and a vertical axis may represent the plurality of compensation gains CGAIN. In other words, the graph of FIG. 5 may represent a relationship between the plurality of compensation values and the plurality of compensation gains CGAIN. For example, the gain generator 322 may include a predetermined look-up table (LUT) corresponding to the graph of FIG. 5. However, embodiments are not limited thereto, and the relationship between the plurality of compensation values and the plurality of compensation gains CGAIN may be changed according to alternate embodiments.

In an embodiment, each of the plurality of compensation data CDAT and each of the plurality of compensation values may correspond to the amount of usage and/or deterioration of each of the plurality of pixels PX.

The multiplier 324 may generate the plurality of output image data OIMG by multiplying the plurality of input image data IIMG and the plurality of compensation gains CGAIN. For example, each of the plurality of input image data IIMG may include a plurality of input pixel values (e.g., grayscale, brightness, luminance, or the like) for the plurality of pixels PX, and each of the plurality of output image data OIMG may include a plurality of output pixel values for the plurality of pixels PX. The multiplier 324 may generate output pixel values included in one output image data unit by multiplying input pixel values included in one input image data unit by corresponding compensation gains, respectively.

For example, the multiplier 324 may generate a plurality of current output pixel values included in current output image data among the plurality of output image data OIMG by multiplying a plurality of current input pixel values included in current input image data among the plurality of input image data IIMG by the plurality of compensation gains CGAIN, respectively.

In an embodiment, as described with reference to FIG. 1, each of the plurality of input image data IIMG and the plurality of output image data OIMG may correspond to one frame image, and thus the compensator 320*a* may perform the above-described compensating operation for each frame image.

The accumulator 330*a* may include an averaging unit 332, a first adder 334, a region selector 336 and a combiner 338.

The averaging unit 332 may group the plurality of pixels PX into a plurality of blocks (e.g., a plurality of blocks BLK in FIG. 9), and may generate current block image data B(t) among the plurality of block image data by sampling current output image data i(t) among the plurality of output image data OIMG in block units. For example, the current block image data B(t) may include a plurality of block values for the plurality of blocks BLK. For example, each of the plurality of block values may be an average value of pixel values for pixels included in each of the plurality of blocks BLK. In other words, the averaging unit 332 may sample (e.g., average) pixel values in block units to generate a low-resolution image, and the current block image data B(t) may represent image information of low-resolution for the entire screen. A detailed operation of the averaging unit 332 will be described with reference to FIGS. 8 and 9.

The first adder 334 may generate current block accumulation data M(t) by adding the current block image data B(t) output from the averaging unit 332 and previous block accumulation data M(t−1) stored in the second memory 340 among the plurality of block accumulation data BADAT. For example, the current block accumulation data M(t) may include a plurality of block accumulation values for the plurality of blocks BLK. In other words, the first adder 334 may perform an accumulating operation in block units. A detailed operation of the first adder 334 will be described with reference to FIGS. 10A and 10B.

In an embodiment, each of the plurality of block accumulation values included in the current block accumulation data M(t) may correspond to the amount of usage and/or deterioration of each of the plurality of pixels PX, and may particularly correspond to the amount of usage and/or deterioration of each of the plurality of blocks BLK. The current block accumulation data M(t) may correspond to the first image information or the first accumulation values of low-resolution described with reference to FIG. 1, and may represent a result of accumulating the image information of low-resolution for the entire screen during a relatively short time interval.

In an embodiment, as described with reference to FIG. 3, the current block accumulation data M(t) may be generated in the first period and may be stored in the second memory 340 in the first period.

The region selector 336 may select a portion $i_{x,y}(t)$ of the current output image data i(t) corresponding to a current block, and may select a portion $M_{X,Y}(t)$ of the current block accumulation data M(t) corresponding to the current block. A detailed operation of the region selector 336 will be described with reference to FIG. 100.

The combiner 338 may generate current pixel accumulation data $Acc_{x,y}(t)$ corresponding to the current block from among the plurality of pixel accumulation data PADAT by synthesizing (or combining or compositing) the selected portion $i_{x,y}(t)$ of the current output image data i(t) and the selected portion $M_{X,Y}(t)$ of the current block accumulation data M(t) based on different weights. In other words, a weight assigned to the selected portion $i_{x,y}(t)$ of the current output image data i(t) and a weight assigned to the selected portion $M_{X,Y}(t)$ of the current block accumulation data M(t) may be different from each other. The current pixel accumulation data $Acc_{x,y}(t)$ may include a plurality of pixel accumulation values for some of the plurality of pixels PX. A detailed operation of the combiner 338 will be described with reference to FIGS. 6, 7 and 10C.

In an embodiment, each of the plurality of pixel accumulation values included in the current pixel accumulation data $Acc_{x,y}(t)$ may correspond to the amount of usage and/or deterioration of each of the plurality of pixels PX. The current pixel accumulation data $Acc_{x,y}(t)$ may correspond to the second image information or the second accumulation values of high-resolution described with reference to FIG. 1, and may represent a result of accumulating the image information of high-resolution for a portion of the screen (e.g., a screen portion corresponding to one block) during a relatively long time interval.

In an embodiment, as described with reference to FIG. 3, the current pixel accumulation data $Acc_{x,y}(t)$ may be generated for the same block in the second period and may be stored in the third memory 200 in the second period.

The adder 352 may generate updated pixel accumulation data $p_{x,y}(t)$ by adding pixel accumulation data $p_{x,y}(t-1)$ stored in the third memory 200 and the current pixel accumulation data $Acc_{x,y}(t)$ output from the combiner 338. The updated pixel accumulation data $p_{x,y}(t)$ may be stored in the third memory 200. In an embodiment, the adder 352 may be included in the write buffer 350 of FIG. 3 or may be implemented separately from the write buffer 350 of FIG. 3.

The third memory 200 may store a plurality of pixel accumulation values for the plurality of pixels PX based on the updated pixel accumulation data $p_{x,y}(t)$, and may provide portions of the plurality of pixel accumulation values stored therein as the plurality of compensation data CDAT.

Figure 6:
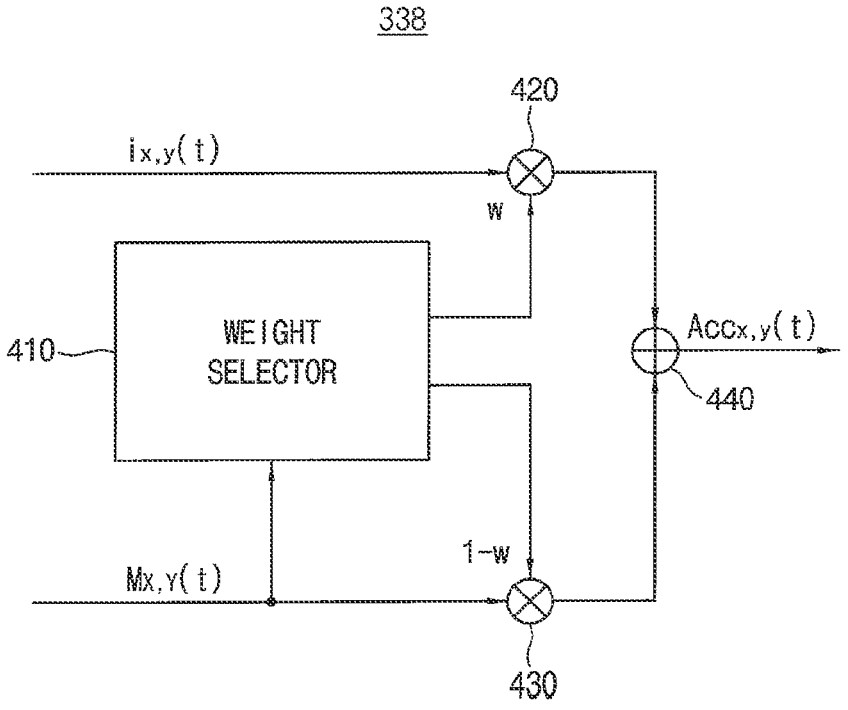
FIG. 6 is a block diagram illustrating an example of a combiner included in the accumulator and compensator of FIG. 4.
Figure 7:
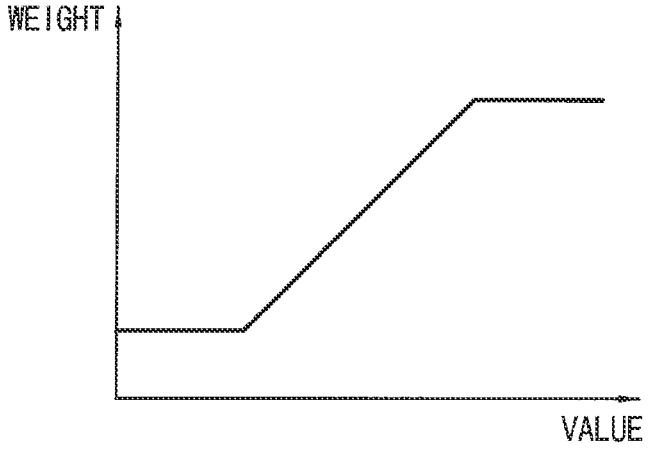
FIG. 7 is a graphical diagram for describing operation of the combiner of FIG. 6.

FIG. 6 is a block diagram illustrating an example of a combiner included in the accumulator and compensator of FIG. 4. FIG. 7 is a diagram for describing an operation of the combiner of FIG. 6.

Referring to FIGS. 6 and 7, the combiner 338 may include a weight selector 410, a first multiplier 420, a second multiplier 430 and a second adder 440.

The weight selector 410 may select a first weight w and a second weight 1−w based on the selected portion $M_{X,Y}(t)$ of the current block accumulation data M(t). For example, a sum of the first weight w and the second weight 1−w may be one, and when one of the first weight w and the second weight 1−w is selected, the other of the first weight w and the second weight 1−w may be automatically determined.

For example, the weight selector 410 may select the first weight w based on a graph of FIG. 7, and may determine the second weight 1−w based on the selected first weight w. In the graph of FIG. 7, a horizontal axis may represent a current block accumulation value included in the selected portion $M_{x,y}(t)$ of the current block accumulation data M(t), and a vertical axis may represent the first weight w. In other words, the graph of FIG. 7 may represent a relationship between the current block accumulation value and the first weight w. For example, the weight selector 410 may include a predetermined look-up table (LUT) corresponding to the graph of FIG. 7.

In an embodiment, as illustrated in FIG. 7, as the current block accumulation value included in the selected portion $M_{x,y}(t)$ of the current block accumulation data M(t) increases, the first weight w may increase. In addition, as the first weight w increases, the second weight 1−w may decrease. However, embodiments are not limited thereto, and the relationship between the current block accumulation value and the first weight w may be changed according to alternate embodiments.

The first multiplier 420 may multiply the selected portion $i_{x,y}(t)$ of the current output image data i(t) by the first weight w. The second multiplier 430 may multiply the selected portion $M_{x,y}(t)$ of the current block accumulation data M(t) by the second weight 1−w. The second adder 440 may generate the current pixel accumulation $Acc_{x,y}(t)$ by adding an output of the first multiplier 420 and an output of the second multiplier 430.

FIGS. 8A, 8B, 8C, 9, 10A, 10B, 100, 10D, 11A, 11B, 11C, 12, 13A and 13B are diagrams for describing an operation of a display driver integrated circuit according to embodiments.

Figure 8A:
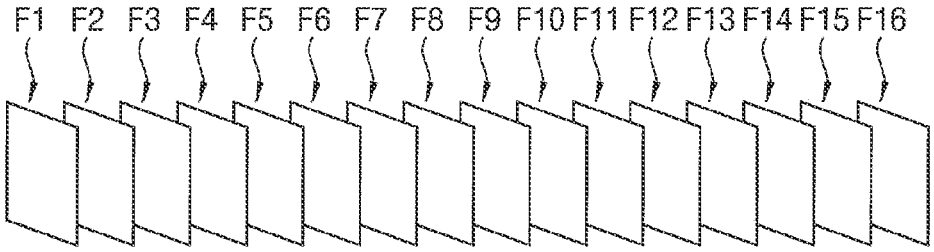
FIGS. 8A, 8B and 8C are conceptual diagrams for describing operations of a display driver integrated circuit according to an embodiment.
Figure 8B:
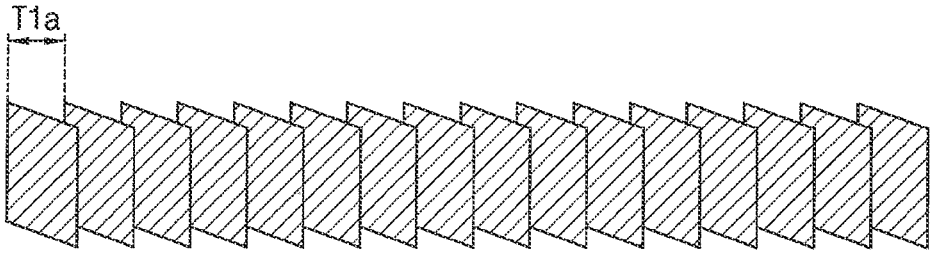
Figure 8C:
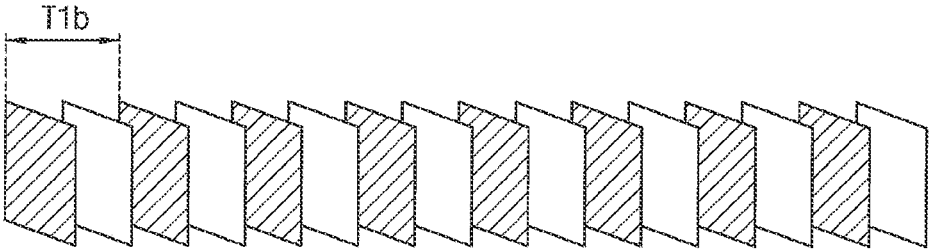

Referring to FIGS. 8A, 8B and 8C, the current output image data i(t) provided from the compensator 320*a* in FIG. 4 to the accumulator 330*a* in FIG. 4 are illustrated.

As illustrated in FIG. 8A, the plurality of output image data OIMG generated based on the plurality of input image data IIMG may correspond to a plurality of frame images F1, F2, F3, F4, F5, F6, F7, F8, F9, F10, F11, F12, F13, F14, F15 and F16. For example, the compensator 320*a* may generate one output image data corresponding to one frame image by performing the compensating operation on one input image data.

As illustrated in FIGS. 8B and 8C, output image data corresponding to hatched frame images among the plurality of frame images F1 to F16 may be provided as the current output image data i(t).

For example, as illustrated in FIG. 8B, the plurality of output image data OIMG corresponding to the plurality of frame images F1 to F16 may be sequentially provided as the current output image data i(t). In this example, an input period T1*a* of the current output image data i(t) may be substantially equal to a frame period, which is a time interval between two adjacent frame images among the plurality of frame images F1 to F16.

For another example, as illustrated in FIG. 8C, output image data corresponding to odd-numbered frame images F1, F3, F5, F7, F9, F11, F13 and F15 among the plurality of frame images F1 to F16 may be sequentially provided as the current output image data i(t). In this example, an input period T1*b* of the current output image data i(t) may be substantially equal to about twice the frame period.

However, embodiments are not limited thereto, and the configuration of the current output image data i(t) may be changed according to alternate embodiments.

As described above, the input period (e.g., the input period T1*a* in FIG. 8B or the input period T1*b* in FIG. 8C) of the current output image data i(t) may be an integer multiple of the frame period. In addition, the current block accumulation data M(t) may be generated whenever the current output image data i(t) is input, and thus the input period of the current output image data i(t) may be substantially the same as the first period in which the current block accumulation data M(t) is generated and is stored in the second memory 340.

Figure 9:
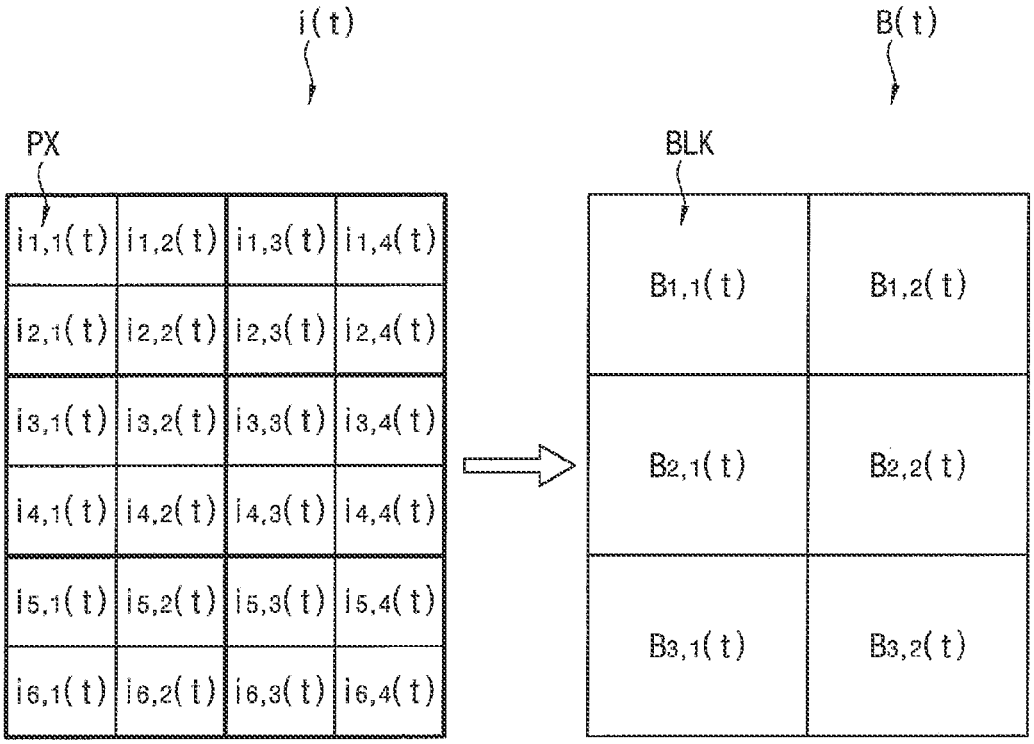
FIG. 9 is a conceptual diagram for describing operations of a display driver integrated circuit according to an embodiment.
Figure 10A:
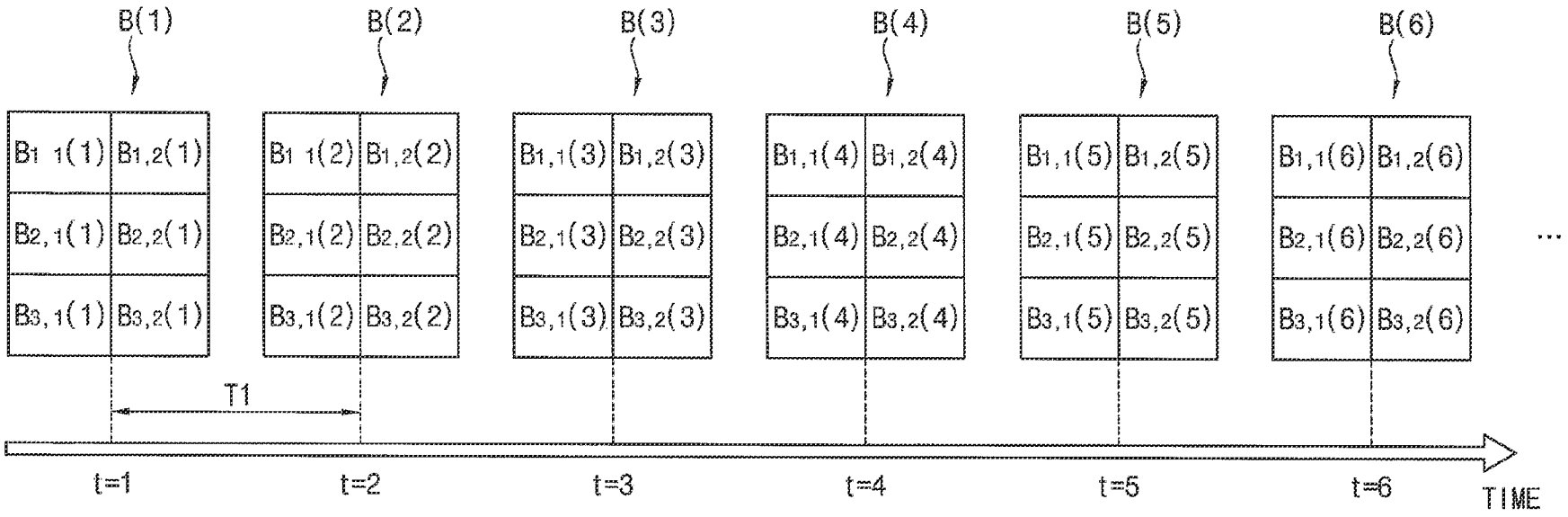

Referring to FIGS. 9 and 10A, an operation of generating the current block image data B(t) by the averaging unit 332 in FIG. 4 is illustrated.

As illustrated in FIG. 9, the current output image data i(t) may include a plurality of output pixel values $i_{1,1}(t)$, $i_{1,2}(t)$, $i_{1,3}(t)$, $i_{1,4}(t)$, $i_{2,1}(t)$, $i_{2,2}(t)$, $i_{2,3}(t)$, $i_{2,4}(t)$, $i_{3,1}(t)$, $i_{3,2}(t)$, $i_{3,3}(t)$, $i_{3,4}(t)$, $i_{4,1}(t)$, $i_{4,2}(t)$, $i_{4,3}(t)$, $i_{4,4}(t)$, $i_{5,1}(t)$, $i_{5,2}(t)$, $i_{5,3}(t)$, $i_{5,4}(t)$, $i_{6,1}(t)$, $i_{6,2}(t)$, $i_{6,3}(t)$ and $i_{6,4}(t)$ corresponding to the plurality of pixels PX. For example, each output pixel value may represent a grayscale, brightness and/or luminance of each pixel. Although FIG. 9 illustrates an example where the number of the plurality of pixels PX is 24 and the current output image data i(t) includes 24 output pixel values corresponding to 24 pixels, embodiments are not limited thereto.

The averaging unit 332 may group the plurality of pixels PX into the plurality of blocks BLK, and may generate the current block image data B(t) by sampling the current output image data i(t) in block units.

In an embodiment, a size of one block may be determined based on the capability or performance of data transmission of the write buffer 350.

The current block image data B(t) may include a plurality of block values $B_{1,1}(t)$, $B_{1,2}(t)$, $B_{2,1}(t)$, $B_{2,2}(t)$, $B_{3,1}(t)$ and $B_{3,2}(t)$ corresponding to the plurality of blocks BLK. Although FIG. 9 illustrates an example where four pixels arranged in a 2*2 matrix are mapped into each block and the current block image data B(t) includes 6 block values corresponding to 6 blocks, embodiments are not limited thereto.

In an embodiment, each block value may be an average value of pixel values of pixels included in each block. For example, the block value $B_{1,1}(t)=(i_{1,1}(t)+i_{1,2}(t)+i_{1,3}(t)+i_{1,4}(t))/4$. The other block values $B_{1,2}(t)$, $B_{2,1}(t)$, $B_{2,2}(t)$, $B_{3,1}(t)$ and $B_{3,2}(t)$ may also be obtained as described above.

As illustrated in FIG. 10A, at a time point of t=1, the averaging unit 332 may generate block image data B(1) that includes block values $B_{1,1}(1)$, $B_{1,2}(1)$, $B_{2,1}(1)$, $B_{2,2}(1)$, $B_{3,1}(1)$ and $B_{3,2}(1)$ by sampling output image data i(1) in block units.

Similarly, at a time point of t=2, the averaging unit 332 may generate block image data B(2) that includes block values $B_{1,1}(2)$, $B_{1,2}(2)$, $B_{2,1}(2)$, $B_{2,2}(2)$, $B_{3,1}(2)$ and $B_{3,2}(2)$ by sampling output image data i(2) in block units. At a time point of t=3, the averaging unit 332 may generate block image data B(3) that includes block values $B_{1,1}(3)$, $B_{1,2}(3)$, $B_{2,1}(3)$, $B_{2,2}(3)$, $B_{3,1}(3)$ and $B_{3,2}(3)$ by sampling output image data i(3) in block units. At a time point of t=4, the averaging unit 332 may generate block image data B(4) that includes block values $B_{1,1}(4)$, $B_{1,2}(4)$, $B_{2,1}(4)$, $B_{2,2}(4)$, $B_{3,1}(4)$ and $B_{3,2}(4)$ by sampling output image data i(4) in block units. At a time point of t=5, the averaging unit 332 may generate block image data B(5) that includes block values $B_{1,1}(5)$, $B_{1,2}(5)$, $B_{2,1}(5)$, $B_{2,2}(5)$, $B_{3,1}(5)$ and $B_{3,2}(5)$ by sampling output image data i(5) in block units. At a time point of t=6, the averaging unit 332 may generate block image data B(6) that includes block values $B_{1,1}(6)$, $B_{1,2}(6)$, $B_{2,1}(6)$, $B_{2,2}(6)$, $B_{3,1}(6)$ and $B_{3,2}(6)$ by sampling output image data i(6) in block units.

As described above, an input period of the output image data i(1), i(2), i(3), i(4), i(5) and i(6) may be a first period T1, and thus the block image data B(1), B(2), B(3), B(4), B(5) and B(6) may be generated in each successive first period T1, respectively.

Figure 10B:
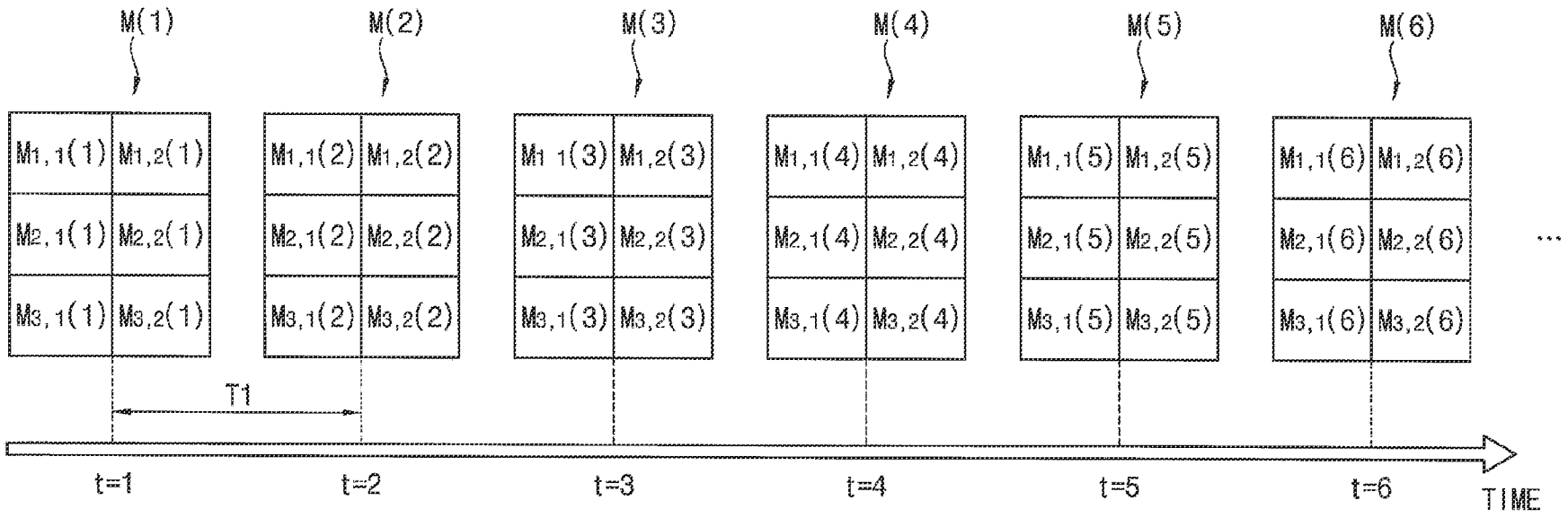

Referring to FIG. 10B, an operation of generating the current block accumulation data M(t) by the first adder 334 in FIG. 4 is illustrated.

For example, at the time point of t=1, the first adder 334 may generate block accumulation data M(1) that includes block accumulation values $M_{1,1}(1)$, $M_{1,2}(1)$, $M_{2,1}(1)$, $M_{2,2}(1)$, $M_{3,1}(1)$ and $M_{3,2}(1)$ by adding the block image data B(1) generated from the averaging unit 332 and previous block accumulation data (e.g., M(0)) stored in the second memory 340. For example, at an initial operation time, block accumulation values of the previous block accumulation data M(0) stored in the second memory 340 may be zero, and thus B(1)=M(1). In other words, $B_{1,1}(1)=M_{1,1}(1)$, $B_{1,2}(1)=M_{1,2}(1)$, $B_{2,1}(1)=M_{2,1}(1)$, $B_{2,2}(1)=M_{2,2}(1)$, $B_{3,1}(1)=M_{3,1}(1)$ and $B_{3,2}(1)=M_{3,2}(1)$.

At the time point of t=2, the first adder 334 may generate block accumulation data M(2) that includes block accumulation values $M_{1,1}(2)$, $M_{1,2}(2)$, $M_{2,1}(2)$, $M_{2,2}(2)$, $M_{3,1}(2)$ and $M_{3,2}(2)$ by adding the block image data B(2) generated from the averaging unit 332 and previous block accumulation data (e.g., M(1)) stored in the second memory 340. For example, M(2)=M(1)+B(2). In other words, $M_{1,1}(2)=M_{1,1}(1)+B_{1,1}(2)$, $M_{1,2}(2)=M_{1,2}(1)+B_{1,2}(2)$, $M_{2,1}(2)=M_{2,1}(1)+B_{2,1}(2)$, $M_{2,2}(2)=M_{2,2}(1)+B_{2,2}(2)$, $M_{3,1}(2)=M_{3,1}(1)+B_{3,1}(2)$ and $M_{3,2}(2)=M_{3,2}(1)+B_{3,2}(2)$.

Similarly, at the time point of t=3, the first adder 334 may generate block accumulation data M(3) that includes block accumulation values $M_{1,1}(3)$, $M_{1,2}(3)$, $M_{2,1}(3)$, $M_{2,2}(3)$, $M_{3,1}(3)$ and $M_{3,2}(3)$ by adding the block image data B(3) generated from the averaging unit 332 and previous block accumulation data (e.g., M(2)) stored in the second memory 340. At the time point of t=4, the first adder 334 may generate block accumulation data M(4) that includes block accumulation values $M_{1,1}(4)$, $M_{1,2}(4)$, $M_{2,1}(4)$, $M_{2,2}(4)$, $M_{3,1}(4)$ and $M_{3,2}(4)$ by adding the block image data B(4) generated from the averaging unit 332 and previous block accumulation data (e.g., M(3)) stored in the second memory 340. At the time point of t=5, the first adder 334 may generate block accumulation data M(5) that includes block accumulation values $M_{1,1}(5)$, $M_{1,2}(5)$, $M_{2,1}(5)$, $M_{2,2}(5)$, $M_{3,1}(5)$ and $M_{3,2}(5)$ by adding the block image data B(5) generated from the averaging unit 332 and previous block accumulation data (e.g., M(4)) stored in the second memory 340. At the time point of t=6, the first adder 334 may generate block accumulation data M(6) that includes block accumulation values $M_{1,1}(6)$, $M_{1,2}(6)$, $M_{2,1}(6)$, $M_{2,2}(6)$, $M_{3,1}(6)$ and $M_{3,2}(6)$ by adding the block image data B(6) generated from the averaging unit 332 and previous block accumulation data (e.g., M(5)) stored in the second memory 340. For example, M(3)=M(2)+B(3), M(4)=M(3)+B(4), M(5)=M(4)+B(5) and M(6)=M(5)+B(6).

As described above, the block image data B(1), B(2), B(3), B(4), B(5) and B(6) may be generated in each successive first period T1, respectively, and thus the block accumulation data M(1), M(2), M(3), M(4), M(5) and M(6) may also be generated in each successive first period T1, respectively. In addition, the block accumulation data M(1), M(2), M(3), M(4), M(5) and M(6) generated from the first adder 334 may be stored in the second memory 340 in each successive first period T1, respectively.

Figure 10C:
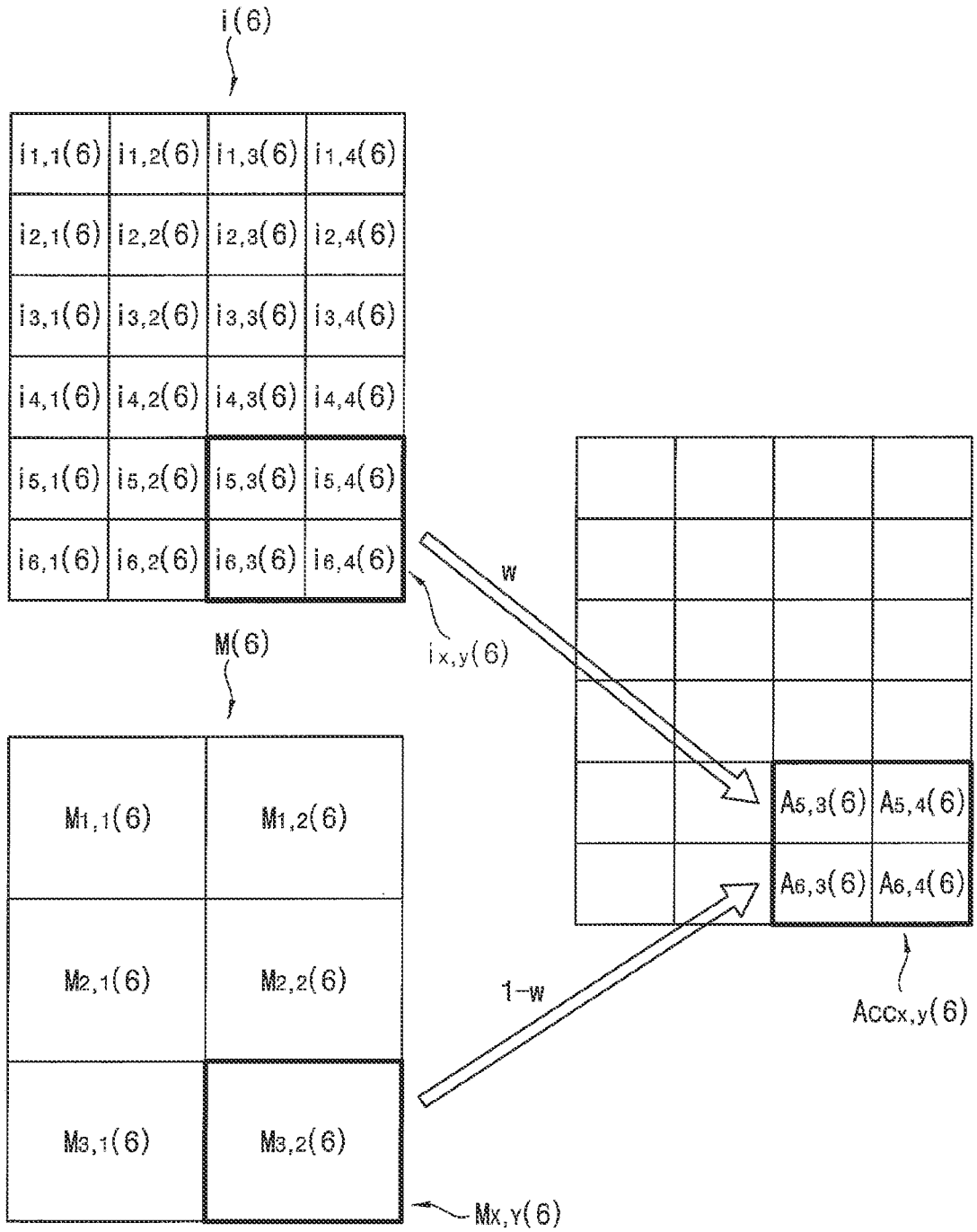

Referring to FIGS. 10C and 10D, an operation of selecting the portion $i_{x,y}(t)$ of the current output image data i(t) and the portion $M_{X,Y}(t)$ of the current block accumulation data M(t) by the region selector 336 in FIG. 4 and an operation of generating the current pixel accumulation data $Acc_{x,y}(t)$ by the combiner 338 in FIG. 4 are illustrated.

At the time points of t=1, t=2, t=3, t=4 and t=5, the block accumulation values stored in the second memory 340 may not be sufficient to generate the current pixel accumulation data $Acc_{x,y}(t)$, and thus the current pixel accumulation data $Acc_{x,y}(t)$ may not be generated.

As illustrated in FIG. 10C, at the time point of t=6, the region selector 336 may select a portion $i_{x,y}(6)$ corresponding to a current block from the output image data i(6), and may select a portion $M_{X,Y}(6)$ corresponding to the current block from the block accumulation data M(6). A portion illustrated by a thick solid line may represent the current block at the time point of t=6. The selected portion $i_{x,y}(6)$ of the output image data i(6) may include output pixel values $i_{5,3}(6)$, $i_{5,4}(6)$, $i_{6,3}(6)$ and $i_{6,4}(6)$ included in the output image data i(6), and the selected portion $M_{X,Y}(6)$ of the block accumulation data M(6) may include a block accumulation value $M_{3,2}(6)$.

At the time point of t=6, the combiner 338 may select the first weight w and the second weight 1−w based on the block accumulation value $M_{3,2}(6)$ included in the selected portion $M_{x,y}(6)$ of the block accumulation data M(6), and may generate pixel accumulation data $Acc_{x,y}(6)$ that includes pixel accumulation values $A_{5,3}(6)$, $A_{5,4}(6)$, $A_{6,3}(6)$ and $A_{6,4}(6)$ by multiplying the selected portion $i_{x,y}(6)$ of the output image data i(6) by the first weight w, by multiplying the selected portion $M_{X,Y}(6)$ of the block accumulation data M(6) by the second weight 1−w, and by summing those two portions to each other. For example, $Acc_{x,y}(6)=w*i_{x,y}(6)+(1-w)*M_{X,Y}(6)$. In other words, $A_{5,3}(6)=w*i_{5,3}(6)+(1-w)*M_{3,2}(6)$, $A_{5,4}(6)=W*i_{5,4}(6)+(1-w)*M_{3,2}(6)$, $A_{6,3}(6)=w*i_{6,3}(6)+(1-w)*M_{3,2}(6)$ and $A_{6,4}(6)=w*i_{6,4}(6)+(1-w)*M_{3,2}(6)$.

Unlike the output image data i(6), the block image data B(6) and the block accumulation data M(6) that correspond to the entire screen, the pixel accumulation data $Acc_{x,y}(6)$ may correspond to a portion of screen (e.g., a screen corresponding to one block). The pixel accumulation data $Acc_{x,y}(6)$ generated from the combiner 338 may be output to and stored in the third memory 200 that is an external memory.

As illustrated in FIG. 10D, at the time point of t=6, the block accumulation data M(6) generated from the first adder 334 may be stored in the second memory 340, and the block accumulation value $M_{3,2}(6)$ corresponding to the current block among the block accumulation values $M_{1,1}(6)$, $M_{1,2}(6)$, $M_{2,1}(6)$, $M_{2,2}(6)$, $M_{3,1}(6)$ and $M_{3,2}(6)$ included in the block accumulation data M(6) stored in the second memory 340 may be initialized or reset while (or after) the pixel accumulation data $Acc_{x,y}(6)$ is generated. The block accumulation value $M_{3,2}(6)$ may be used to generate the pixel accumulation data $Acc_{x,y}(6)$ and need not be used afterwards, and thus the block accumulation value $M_{3,2}(6)$ may be reset or initialized for a next or subsequent accumulating operation.

Figure 11A:
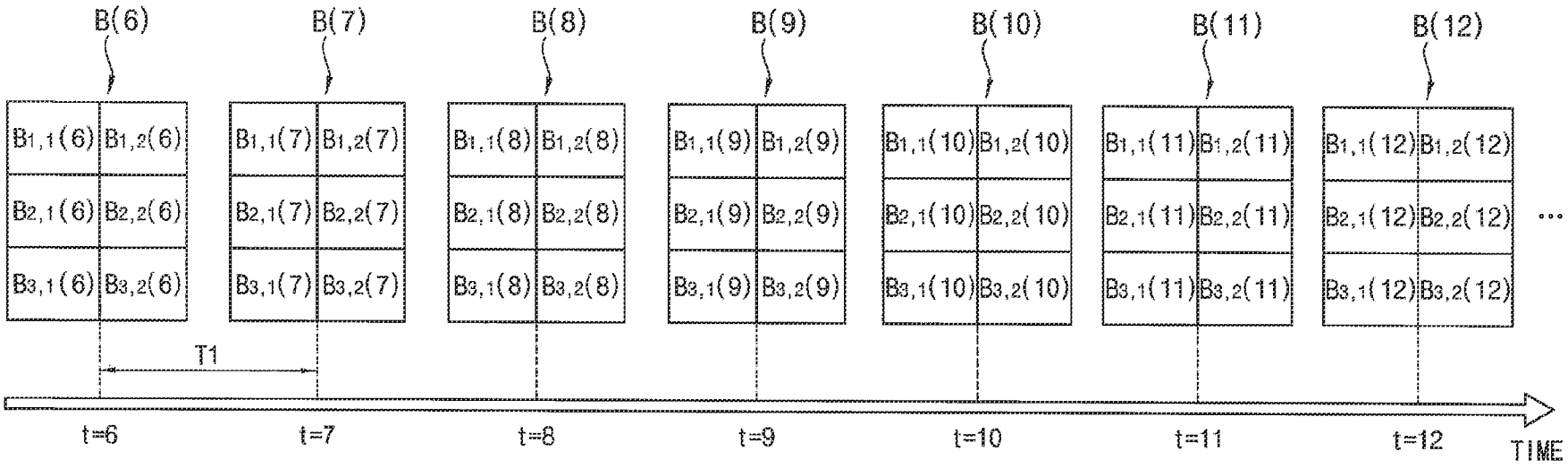
FIGS. 11A, 11B and 11C are conceptual diagrams for describing operations of a display driver integrated circuit according to an embodiment.
Figure 11B:
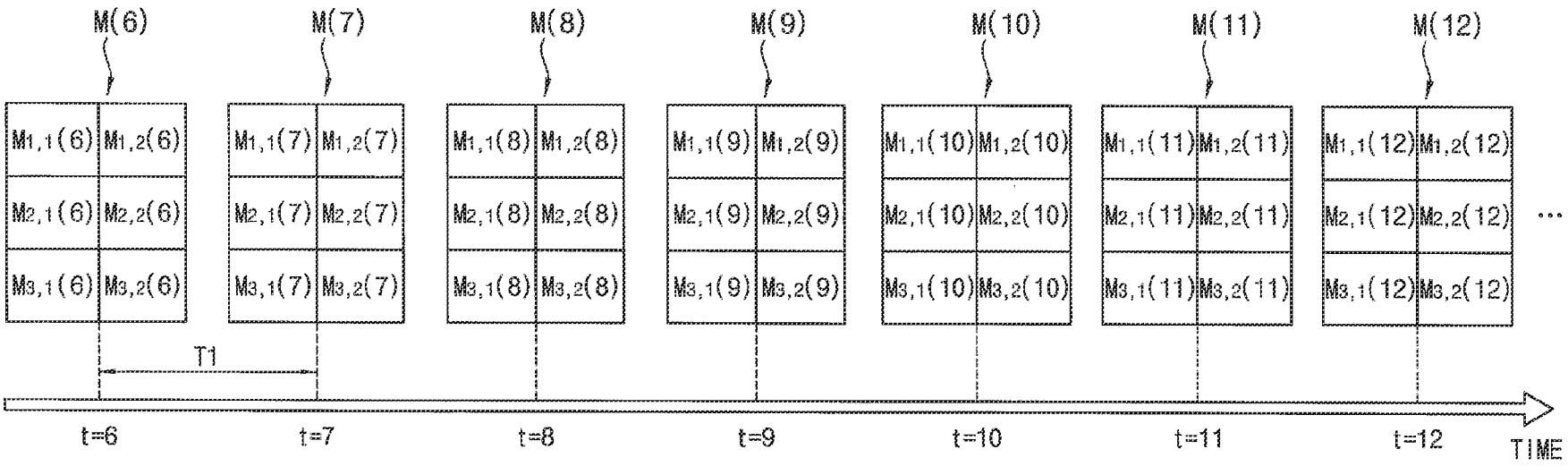
Figure 11C:
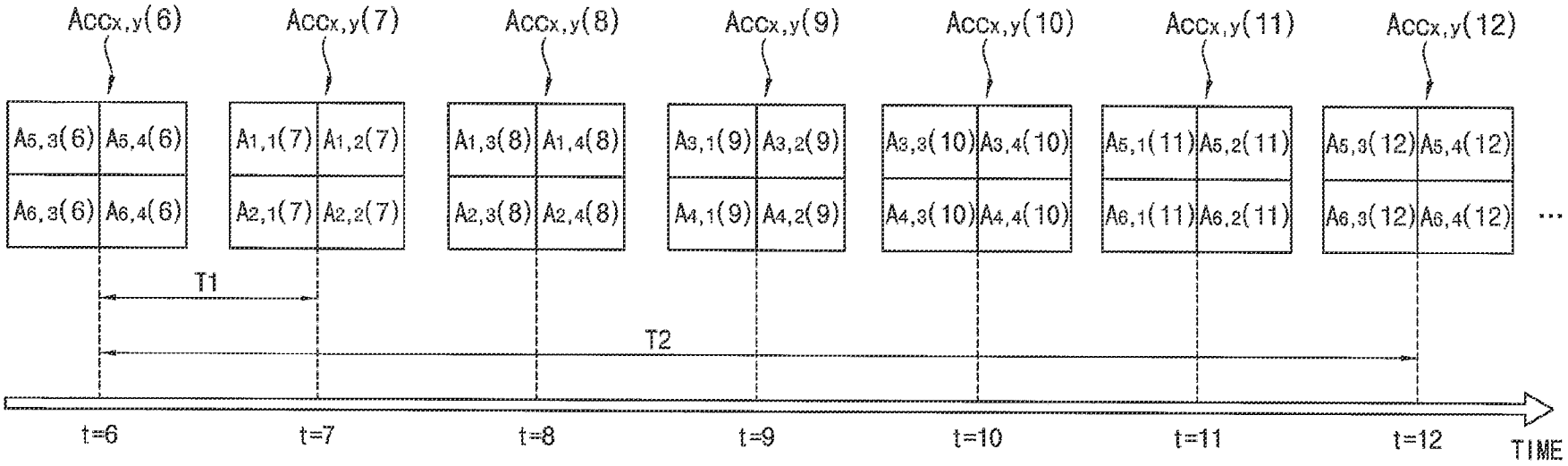

Referring to FIGS. 11A, 11B and 110, an operation of generating the current block image data B(t) by the averaging unit 332 in FIG. 4, an operation of generating the current block accumulation data M(t) by the first adder 334 in FIG. 4, an operation of selecting the portion $i_{x,y}(t)$ of the current output image data i(t) and the portion $M_{x,y}(t)$ of the current block accumulation data M(t) by the region selector 336 in FIG. 4 and an operation of generating the current pixel accumulation data $Acc_{x,y}(t)$ by the combiner 338 in FIG. 4 are illustrated after the time point of t=6.

As with the operations described with reference to FIGS. 9, 10A, 10B, 100 and 10D, at a time point of t=7, the averaging unit 332 may generate block image data B(7) that includes block values $B_{1,1}(7)$, $B_{1,2}(7)$, $B_{2,1}(7)$, $B_{2,2}(7)$, $B_{3,1}(7)$ and $B_{3,2}(7)$. The first adder 334 may generate block accumulation data M(7) that includes block accumulation values $M_{1,1}(7)$, $M_{1,2}(7)$, $M_{2,1}(7)$, $M_{2,2}(7)$, $M_{3,1}(7)$ and $M_{3,2}(7)$. The block accumulation data M(7) may be stored in the second memory 340. The region selector 336 and the combiner 338 may generate pixel accumulation data $Acc_{x,y}(7)$ that includes pixel accumulation values $A_{1,1}(7)$, $A_{1,2}(7)$, $A_{2,1}(7)$ and $A_{2,2}(7)$, and the current block may correspond to a position of the block accumulation value $M_{1,1}(7)$. In addition, the block accumulation value $M_{1,1}(7)$ corresponding to the current block and included in the block accumulation data M(7) stored in the second memory 340 may be initialized while the pixel accumulation data $Acc_{x,y}(7)$ is generated.

Similarly, at a time point of t=8, the averaging unit 332 may generate block image data B(8) that includes block values $B_{1,1}(8)$, $B_{1,2}(8)$, $B_{2,1}(8)$, $B_{2,2}(8)$, $B_{3,1}(8)$ and $B_{3,2}(8)$. The first adder 334 may generate block accumulation data M(8) that includes block accumulation values $M_{1,1}(8)$, $M_{1,2}(8)$, $M_{2,1}(8)$, $M_{2,2}(8)$, $M_{3,1}(8)$ and $M_{3,2}(8)$. The block accumulation data M(8) may be stored in the second memory 340. The region selector 336 and the combiner 338 may generate pixel accumulation data $Acc_{x,y}(8)$ that includes pixel accumulation values $A_{1,3}(8)$, $A_{1,4}(8)$, $A_{2,3}(8)$ and $A_{2,4}(8)$, and the current block may correspond to a position of the block accumulation value $M_{1,2}(8)$. In addition, the block accumulation value $M_{1,2}(8)$ corresponding to the current block and included in the block accumulation data M(8) stored in the second memory 340 may be initialized while the pixel accumulation data $Acc_{x,y}(8)$ is generated.

At a time point of t=9, the averaging unit 332 may generate block image data B(9) that includes block values $B_{1,1}(9)$, $B_{1,2}(9)$, $B_{2,1}(9)$, $B_{2,2}(9)$, $B_{3,1}(9)$ and $B_{3,2}(9)$. The first adder 334 may generate block accumulation data M(9) that includes block accumulation values $M_{1,1}(9)$, $M_{1,2}(9))$ $M_{2,1}(9))$ $M_{2,2}(9)$, $M_{3,1}(9)$ and $M_{3,2}(9)$. The block accumulation data M(9) may be stored in the second memory 340. The region selector 336 and the combiner 338 may generate pixel accumulation data $Acc_{x,y}(9)$ that includes pixel accumulation values $A_{3,1}(9)$, $A_{3,2}(9)$, $A_{4,1}(9)$ and $A_{4,2}(9)$, and the current block may correspond to a position of the block accumulation value $M_{2,1}(9)$. In addition, the block accumulation value $M_{2,1}(9)$ corresponding to the current block and included in the block accumulation data M(9) stored in the second memory 340 may be initialized while the pixel accumulation data $Acc_{x,y}(9)$ is generated.

At a time point of t=10, the averaging unit 332 may generate block image data B(10) that includes block values $B_{1,1}(10)$, $B_{1,2}(10)$, $B_{2,1}(10)$, $B_{2,2}(10)$, $B_{3,1}(10)$ and $B_{3,2}(10)$. The first adder 334 may generate block accumulation data M(10) that includes block accumulation values $M_{1,1}(10)$, $M_{1,2}(10)$, $M_{2,1}(10)$, $M_{2,2}(10)$, $M_{3,1}(10)$ and $M_{3,2}(10)$. The block accumulation data M(10) may be stored in the second memory 340. The region selector 336 and the combiner 338 may generate pixel accumulation data $Acc_{x,y}(10)$ that includes pixel accumulation values $A_{3,3}(10)$, $A_{3,4}(10)$, $A_{4,3}(10)$ and $A_{4,4}(10)$, and the current block may correspond to a position of the block accumulation value $M_{2,2}(10)$. In addition, the block accumulation value $M_{2,2}(10)$ corresponding to the current block and included in the block accumulation data M(10) stored in the second memory 340 may be initialized while the pixel accumulation data $Acc_{x,y}(10)$ is generated.

At a time point of t=11, the averaging unit 332 may generate block image data B(11) that includes block values $B_{1,1}(11)$, $B_{1,2}(11)$, $B_{2,1}(11)$, $B_{2,2}(11)$, $B_{3,1}(11)$ and $B_{3,2}(11)$. The first adder 334 may generate block accumulation data M(11) that includes block accumulation values $M_{1,1}(11)$, $M_{1,2}(11)$, $M_{2,1}(11)$, $M_{2,2}(11)$, $M_{3,1}(11)$ and $M_{3,2}(11)$. The block accumulation data M(11) may be stored in the second memory 340. The region selector 336 and the combiner 338 may generate pixel accumulation data $Acc_{x,y}(11)$ that includes pixel accumulation values $A_{5,1}(11)$, $A_{5,2}(11)$, $A_{6,1}(11)$ and $A_{6,2}(11)$, and the current block may correspond to a position of the block accumulation value $M_{3,1}(11)$. In addition, the block accumulation value $M_{3,1}(11)$ corresponding to the current block and included in the block accumulation data M(11) stored in the second memory 340 may be initialized while the pixel accumulation data $Acc_{x,y}(11)$ is generated.

At a time point of t=12, the averaging unit 332 may generate block image data B(12) that includes block values $B_{1,1}(12)$, $B_{1,2}(12)$, $B_{2,1}(12)$, $B_{2,2}(12)$, $B_{3,1}(12)$ and $B_{3,2}(12)$. The first adder 334 may generate block accumulation data M(12) that includes block accumulation values $M_{1,1}(12)$, $M_{1,2}(12)$, $M_{2,1}(12)$, $M_{2,2}(12)$, $M_{3,1}(12)$ and $M_{3,2}(12)$. The block accumulation data M(12) may be stored in the second memory 340. The region selector 336 and the combiner 338 may generate pixel accumulation data $Acc_{x,y}(12)$ that includes pixel accumulation values $A_{5,3}(12)$, $A_{5,4}(12)$, $A_{6,3}(12)$ and $A_{6,4}(12)$, and the current block may correspond to a position of the block accumulation value $M_{3,2}(12)$. In addition, the block accumulation value $M_{3,2}(12)$ corresponding to the current block and included in the block accumulation data M(12) stored in the second memory 340 may be initialized while the pixel accumulation data $Acc_{x,y}(12)$ is generated.

As the above-described operation is repeated, a pixel accumulation value for the same pixel may be stored in the third memory 200 in the second period T2. For example, as with the block image data M(6), M(7), M(8), M(9), M(10), M(11) and M(12) illustrated in FIG. 11B, the pixel accumulation data $Acc_{x,y}(6)$, $Acc_{x,y}(7)$, $Acc_{x,y}(8)$, $Acc_{x,y}(9)$, $Acc_{x,y}(10)$, $Acc_{x,y}(11)$ and $Acc_{x,y}(12)$ may be generated in each successive first period T1, respectively, and stored in the third memory 200 in each successive first period T1, respectively, as illustrated in FIG. 11C. However, the pixel accumulation data $Acc_{x,y}(6)$, $Acc_{x,y}(7)$, $Acc_{x,y}(8)$, $Acc_{x,y}(9)$, $Acc_{x,y}(10)$ and $Acc_{x,y}(11)$ may include the pixel accumulation values for different blocks, and the pixel accumulation data $Acc_{x,y}(6)$ and $Acc_{x,y}(12)$ may include the pixel accumulation values for the same block. As a result, the pixel accumulation data $Acc_{x,y}(6)$ and $Acc_{x,y}(12)$ for the same block and generated from the combiner 338 may be generated in the second period T2 and stored in the third memory 200 in the second period T2.

As described above, the second period T2 may be an integer multiple of the first period T1. Although embodiments are described based on a case of T2=6*T1, embodiments are not limited thereto.

Figure 12:
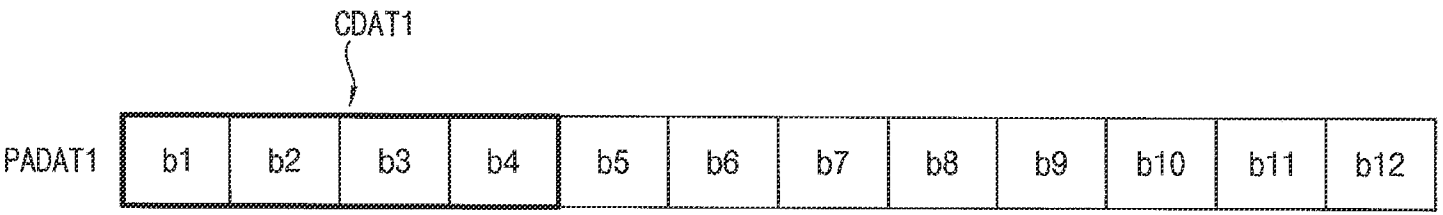
FIG. 12 is a data diagram for describing operations of a display driver integrated circuit according to an embodiment.

Referring to FIG. 12, a first pixel accumulation value PADAT1 and a first compensation value CDAT1 are illustrated. The first pixel accumulation value PADAT1 may be included in the plurality of pixel accumulation data PADAT stored in the third memory 200 and may correspond to a first pixel among the plurality of pixels PX. The first compensation value CDAT1 may be included in the plurality of compensation data CDAT stored in the first memory 310 and may correspond to the first pixel.

As described above, the first pixel accumulation value PADAT1 and the first compensation value CDAT1 may correspond to or represent the amount of usage and/or deterioration of the first pixel. For example, the amount of usage or deterioration of the first pixel may be proportional to a light emitting level (or intensity) of the first pixel and proportional to a light emitting time of the first pixel. Thus, the amount of usage and/or deterioration of the first pixel may correspond to the accumulated amount of grayscale and/or time using the first pixel.

The first compensation value CDAT1 may be a portion of the first pixel accumulation value PADAT1. For example, the first compensation value CDAT1 may correspond to the most significant m (where m is a natural number) bits among a plurality of bits b1, b2, b3, b4, b5, b6, b7, b8, b9, b10, b11 and b12 included in the first pixel accumulation value PADAT1. Although FIG. 12 illustrates that m=4, embodiments are not limited thereto.

Figure 13A:
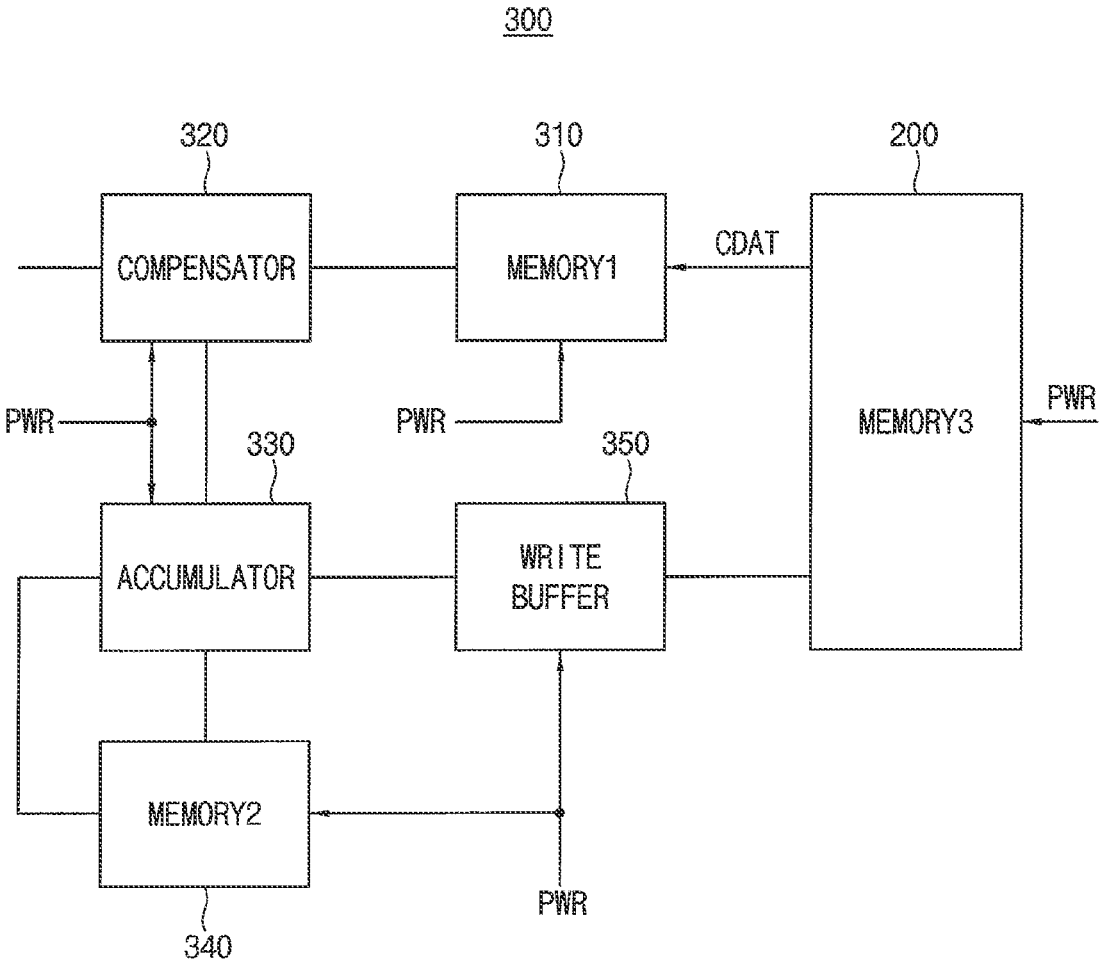
FIGS. 13A and 13B are block diagrams for describing operations of a display driver integrated circuit according to an embodiment.
Figure 13B:
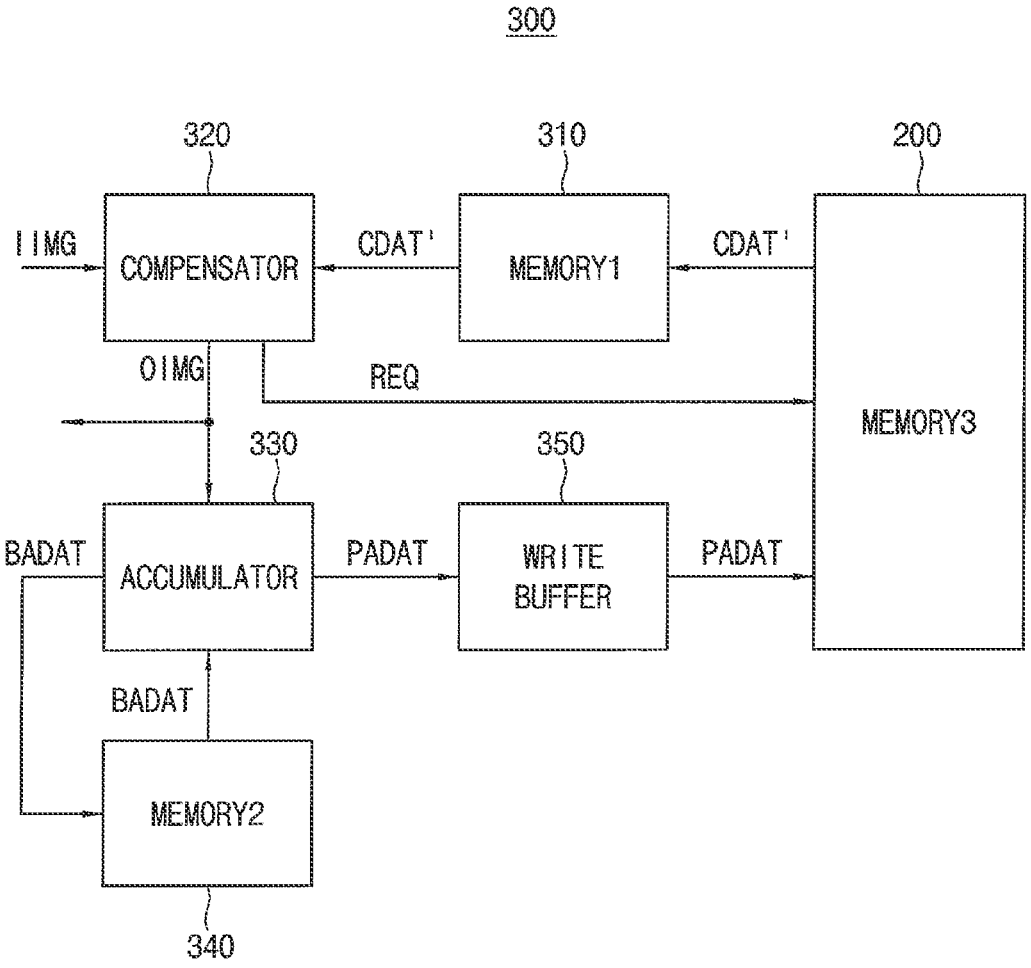

Referring to FIGS. 13A and 13B, an operation is illustrated of storing the plurality of compensation data CDAT, which are portions of the plurality of pixel accumulation data PADAT, in the first memory 310.

In an embodiment, as illustrated in FIG. 13A, when the display driver integrated circuit is powered on, such as when a power supply voltage PWR starts to be applied to elements included in the display driver integrated circuit, the plurality of compensation data CDAT may be loaded from the third memory 200 and may be stored in the first memory 310.

In an embodiment, as illustrated in FIG. 13B, after the plurality of compensation data CDAT are loaded from the third memory 200 and are stored in the first memory 310 while being powered on, the compensator 320 may provide a request signal REQ to the third memory 200, and a plurality of updated compensation data CDAT' may be loaded from the third memory 200 and may be stored in the first memory 310 based on the request signal REQ. The plurality of compensation data CDAT may be continuously updated while the display driver integrated circuit is operating, and thus the compensator 320 may generate the request signal REQ to reflect the plurality of updated compensation data CDAT'.

In an embodiment, the request signal REQ may be periodically generated in a third period T3 longer than the second period T2. In other words, the plurality of updated compensation data CDAT' may be loaded from the third memory 200 in the third period and may be stored in the first memory 310 in the third period.

In the display driver integrated circuit compensating for the deterioration of the plurality of pixels PX based on the cumulative compensating scheme according to an embodiment, the plurality of pixel accumulation data PADAT corresponding to the amount of usage and/or deterioration of the plurality of pixels PX may be stored in the third memory 200, which may be a nonvolatile memory disposed outside the display driver integrated circuit. Accordingly, an internal volatile memory having relatively large capacity may be omitted, and the power consumption and chip size may be minimized.

In addition, the plurality of compensation data CDAT, which are portions of the plurality of pixel accumulation data PADAT stored in the third memory 200, may be loaded and stored in the first memory 310, which may be a relatively small volatile memory disposed inside the display driver integrated circuit. The compensating operation may be performed based on the plurality of compensation data CDAT. Accordingly, the first memory 310 may be implemented with relatively small capacity, and a time to load the plurality of compensation data CDAT (e.g., an initial loading time) may be minimized.

Further, in order to reflect frequent changes in images, the plurality of block accumulation data BADAT, which are accumulated image information of small size and low resolution, may be stored in the second memory 340, which may be another volatile memory disposed inside the display driver integrated circuit, in the first period T1. Additionally, the plurality of pixel accumulation data PADAT, which are accumulated image information of large size and high resolution and are generated based on the plurality of output image data OIMG and the plurality of block accumulation data BADAT, may be stored in the third memory 200 in the second period T2. The first period T1 may be a relatively short time interval, and the second period T2 may be a relatively long time interval. Accordingly, the second memory 340 may be implemented with relatively small capacity, and the power consumption and chip size may be minimized without degrading compensation performance.

Figure 14:
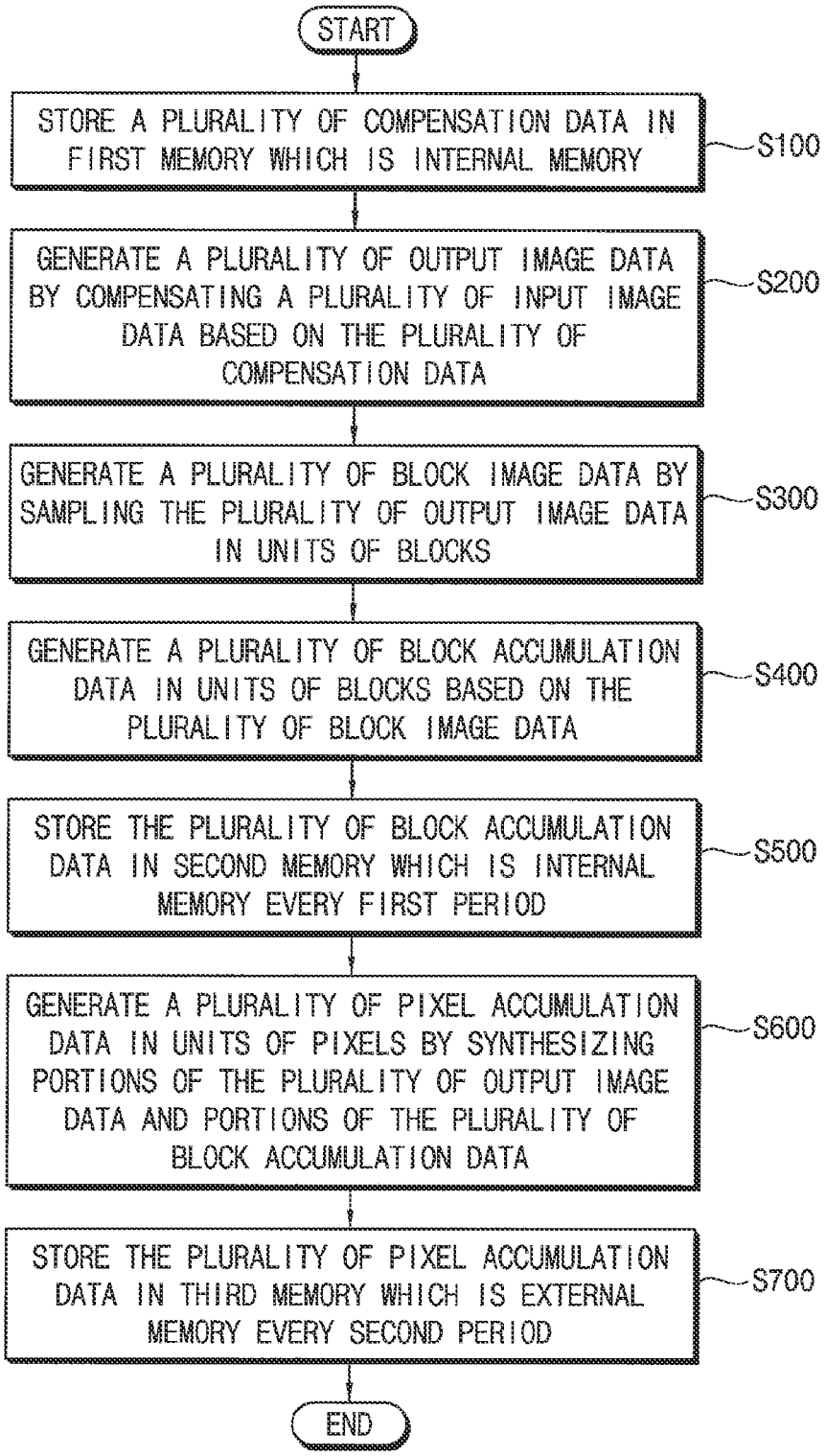
FIG. 14 is a flowchart diagram illustrating a method of driving a display panel according to an embodiment.

FIG. 14 is a flowchart illustrating a method of driving a display panel according to an embodiment.

Referring to FIGS. 1, 3 and 14, in a method of driving a display panel according to an embodiment, the plurality of compensation data CDAT that are used to compensate for the deterioration of the plurality of pixels PX are stored in the first memory 310 at function block S100.

The plurality of output image data OIMG for image display are generated by compensating the plurality of input image data IIMG based on the plurality of compensation data CDAT at function block S200. Function block S200 may be performed by the compensator 320.

The plurality of block image data may be generated by grouping the plurality of pixels PX into the plurality of blocks BLK and by sampling the plurality of output image data OIMG in block units at function block S300. The plurality of block accumulation data BADAT are generated in block units based on the plurality of block image data at function block S400. The plurality of block accumulation data BADAT are stored in the second memory 340 in the first period T1 at function block S500. Function blocks S300, S400 and S500 may be performed by the accumulator 330, and may be performed as described with reference to FIGS. 8A, 8B, 8C, 9, 10A and 10B.

The plurality of pixel accumulation data PADAT are generated in pixel units by synthesizing portions of the plurality of output image data OIMG and portions of the plurality of block accumulation data BADAT at function block S600. The plurality of pixel accumulation data PADAT are stored in the third memory 200 in the second period T2 longer than the first period T1 at function block S700. Function blocks S600 and S700 may be performed by the accumulator 330, and may be performed as described with reference to FIGS. 6, 7, 10C, 10D and 11C.

As will be appreciated by those skilled in the art, the inventive concept may be embodied as a system, method, computer program product, and/or a computer program product embodied in one or more computer readable medium(s) having computer readable program code embodied thereon. The computer readable program code may be provided to a processor of a general-purpose computer, special-purpose computer, or other programmable data processing apparatus. The computer readable medium may be a computer readable signal medium or a computer readable storage medium. The computer readable storage medium may be any tangible medium that can contain or store a program for use by or in connection with an instruction execution system, apparatus, or device. For example, the computer readable medium may be a non-transitory computer readable medium.

Figure 15:
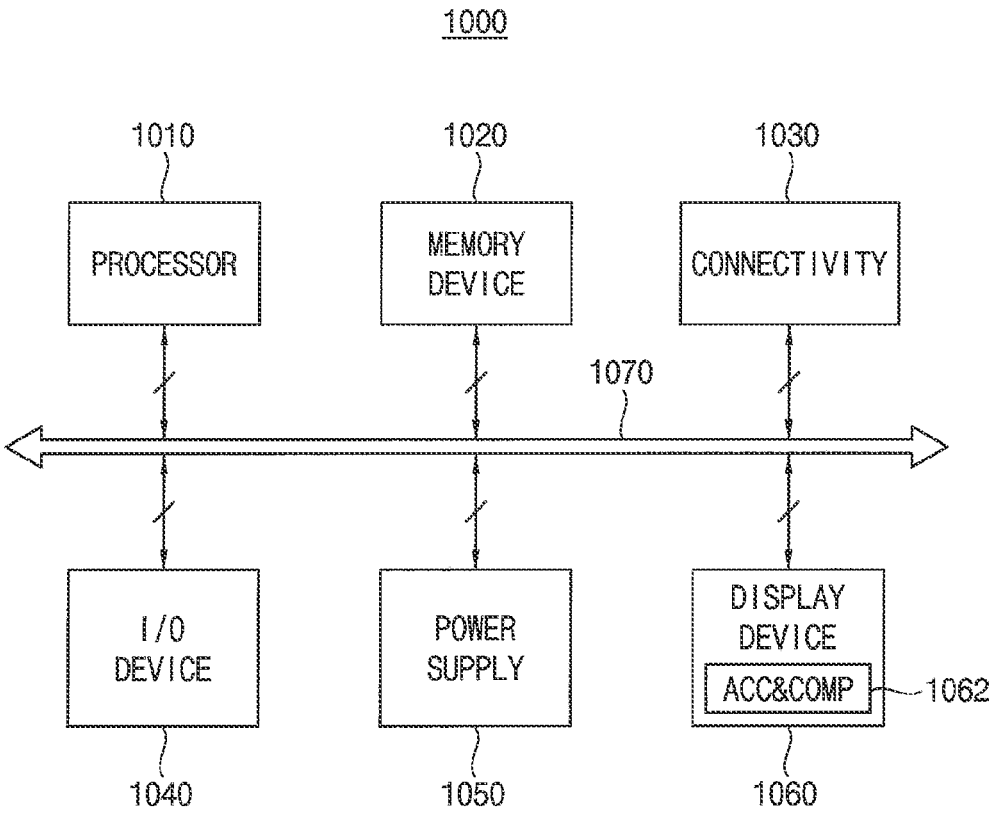
FIG. 15 is a block diagram illustrating an electronic system according to an embodiment.

FIG. 15 is a block diagram illustrating an electronic system according to embodiments.

Referring to FIG. 15, an electronic system 1000 may include a processor 1010, a memory device 1020, a connectivity interface 1030, an input/output (I/O) device 1040, a power supply 1050, a display device 1060, and a communications bus 1070. The electronic system 1000 may further include a plurality of ports for communicating, a video card, a sound card, a memory card, a universal serial bus (USB) device, other electronic devices, or the like.

The processor 1010 controls operations of the electronic system 1000. The processor 1010 may execute an operating system and at least one application to provide an internet browser, games, videos, or the like. The memory device 1020 may store data for the operations of the electronic system 1000. The connectivity interface 1030 may communicate with an external device and/or system. The I/O device 1040 may include an input device such as a keyboard, a keypad, a mouse, a touchpad, a touch-screen, a remote controller, or the like, and an output device such as a printer, a speaker, or the like. The power supply 1050 may provide a power for operations of the electronic system 1000.

The display device 1060 includes a display panel and a display driver integrated circuit. The display device 1060 and the display driver integrated circuit may be the display device and the display driver integrated circuit according to embodiments, respectively. The display driver integrated circuit may include an accumulator and compensator 1062 that compensates for the deterioration of the plurality of pixels PX based on the cumulative compensating scheme, and may have the structure and operate as described with reference to FIGS. 3 through 14.

The inventive concept may be applied to various electronic devices and systems that include such display driver integrated circuits, such as display devices. For example, the inventive concept may be applied to systems such as a personal computer (PC), a server computer, a data center, a workstation, a mobile phone, a smart phone, a tablet computer, a laptop computer, a personal digital assistant (PDA), a portable multimedia player (PMP), a digital camera, a portable game console, a music player, a camcorder, a video player, a navigation device, a wearable device, an internet of things (IoT) device, an internet of everything (IoE) device, an e-book reader, a virtual reality (VR) device, an augmented reality (AR) device, a robotic device, a drone, or the like.

The foregoing is illustrative of the inventive concept and is not to be construed as limiting thereof. Although some embodiments have been described for illustrative purposes, those of ordinary skill in the pertinent art will readily appreciate that many modifications are possible in the embodiments without materially departing from the novel teachings of the present disclosure. Accordingly, all such modifications are intended to be included within the scope of the embodiments as defined in the claims. Therefore, it is to be understood that the foregoing is illustrative of various embodiments and is not to be construed as limited to the specific embodiments disclosed, and that modifications to the disclosed embodiments, as well as other embodiments, are intended to be included within the scope of the appended claims.

What is claimed is:

1. A display driver integrated circuit for driving a display panel including a plurality of pixels, comprising:

a memory configured to store a plurality of compensation data;

a compensator configured to generate a plurality of output image data based on the plurality of compensation data; and an accumulator configured to group the plurality of pixels into a plurality of blocks, to generate a plurality of block image data by sampling the plurality of output image data in block units, to generate a plurality of block accumulation data in block units based on the plurality of block image data and to store the plurality of block accumulation data into the memory in a first period, and to generate a plurality of pixel accumulation data in pixel units by synthesizing portions of the plurality of output image data and portions of the plurality of block accumulation data.

2. The display driver integrated circuit of claim 1, wherein:

the plurality of compensation data are used to compensate for deterioration of the plurality of pixels, the plurality of output image data is generated for image display by compensating a plurality of input image data based on the plurality of compensation data, the memory includes a first memory configured to store the plurality of compensation data and a second memory configured to store the plurality of block accumulation data, and the plurality of pixel accumulation data are stored in an external third memory in a second period longer than the first period.

3. The display driver integrated circuit of claim 2, wherein:

each of the plurality of pixel accumulation data corresponds to one of the plurality of blocks and includes a plurality of pixel accumulation values for one of the plurality of blocks, and pixel accumulation data corresponding to a same block among the plurality of pixel accumulation data are generated for the same block in the second period and are stored in the third memory in the second period the plurality of pixel accumulation data are generated in the first period, and the second period is an integer multiple of the first period.

4. The display driver integrated circuit of claim 2, wherein the plurality of compensation data are portions of the plurality of pixel accumulation data stored in the third memory.

5. The display driver integrated circuit of claim 4, wherein:

the plurality of compensation data include a plurality of compensation values for the plurality of pixels, the plurality of pixel accumulation data include a plurality of pixel accumulation values for the plurality of pixels, and the plurality of compensation values correspond to upper m bits of the plurality of pixel accumulation values, where m is a natural number.

6. The display driver integrated circuit of claim 4, wherein, when the display driver integrated circuit is powered on, the plurality of compensation data are loaded from the third memory and are stored in the first memory.

7. The display driver integrated circuit of claim 4, wherein the plurality of compensation data are loaded from the third memory and are stored in the first memory in a third period longer than the second period.

8. The display driver integrated circuit of claim 2, wherein:

each of the first memory and the second memory includes a volatile memory, and the third memory includes a nonvolatile memory.

9. The display driver integrated circuit of claim 1, wherein:

each of the plurality of block accumulation data corresponds to the plurality of blocks and includes a plurality of block accumulation values for the plurality of blocks, and the plurality of block accumulation data are generated for the plurality of blocks in the first period and are stored in the memory in the first period.

10. The display driver integrated circuit of claim 1, wherein the accumulator includes:

an averaging unit configured to group the plurality of pixels into the plurality of blocks, and to generate current block image data among the plurality of block image data by sampling current output image data among the plurality of output image data in block units;

a first adder configured to generate current block accumulation data by adding the current block image data and previous block accumulation data among the plurality of block accumulation data;

a region selector configured to select a portion of the current output image data corresponding to a current block and a portion of the current block accumulation data corresponding to the current block; and a combiner configured to generate current pixel accumulation data corresponding to the current block among the plurality of pixel accumulation data by synthesizing the selected portion of the current output image data and the selected portion of the current block accumulation data based on different weights.

11. The display driver integrated circuit of claim 10, wherein the combiner includes:

a weight selector configured to select a first weight and a second weight based on the selected portion of the current block accumulation data;

a first multiplier configured to multiply the selected portion of the current output image data by the first weight;

a second multiplier configured to multiply the selected portion of the current block accumulation data by the second weight; and a second adder configured to generate the current pixel accumulation data by adding an output of the first multiplier and an output of the second multiplier.

12. The display driver integrated circuit of claim 11, wherein, as a current block accumulation value included in the selected portion of the current block accumulation data increases, the first weight increases and the second weight decreases.

13. The display driver integrated circuit of claim 11, wherein the weight selector includes a predetermined look-up table (LUT).

14. The display driver integrated circuit of claim 10, wherein the current block accumulation data generated by the first adder is stored in the memory.

15. The display driver integrated circuit of claim 14, wherein a current block accumulation value corresponding to the current block among block accumulation values included in the current block accumulation data stored in the memory is initialized while generating the current pixel accumulation data.

16. The display driver integrated circuit of claim 1, wherein the compensator includes:

a gain generator configured to generate a plurality of compensation gains based on the plurality of compensation data; and a multiplier configured to generate a plurality of current output pixel values included in current output image data among the plurality of output image data by multiplying a plurality of current input pixel values included in current input image data among the plurality of input image data by the plurality of compensation gains.

17. The display driver integrated circuit of claim 1, wherein the plurality of block accumulation data, the plurality of pixel accumulation data and the plurality of compensation data correspond to a usage of the plurality of pixels.

18. The display driver integrated circuit of claim 1, further comprising:

a data driver configured to generate a plurality of data voltages applied to the plurality of pixels based on the plurality of output image data; and a scan driver configured to generate a plurality of scan signals applied to the plurality of pixels.

19. A display device comprising:

a display panel including a plurality of pixels; and a display driver integrated circuit configured to drive the display panel, the display driver integrated circuit comprising:

a first memory configured to store a plurality of compensation data that are used to compensate for deterioration of the plurality of pixels;

a compensator configured to generate a plurality of output image data for image display by compensating a plurality of input image data based on the plurality of compensation data;

an accumulator configured to group the plurality of pixels into a plurality of blocks, to generate a plurality of block image data by sampling the plurality of output image data in block units, to generate a plurality of block accumulation data in block units based on the plurality of block image data, and to generate a plurality of pixel accumulation data in pixel units by synthesizing portions of the plurality of output image data and portions of the plurality of block accumulation data; and a second memory configured to store the plurality of block accumulation data in a first period, and wherein the plurality of pixel accumulation data are stored in a third memory in a second period longer than the first period, and the third memory is located outside the display driver integrated circuit.

20. A method of driving a display panel including a plurality of pixels, the method comprising:

storing a plurality of compensation data that are used to compensate for deterioration of the plurality of pixels in a first memory;

generating a plurality of output image data for image display by compensating a plurality of input image data based on the plurality of compensation data;

generating a plurality of block image data by grouping the plurality of pixels into a plurality of blocks and by sampling the plurality of output image data in block units;

generating a plurality of block accumulation data in block units based on the plurality of block image data;

storing the plurality of block accumulation data in a second memory in a first period;

generating a plurality of pixel accumulation data in pixel units by synthesizing portions of the plurality of output image data and portions of the plurality of block accumulation data; and storing the plurality of pixel accumulation data in a third memory in a second period longer than the first period, the third memory being an external memory.

* * * * *